US008094104B2

(12) United States Patent
Kinjo et al.

(10) Patent No.: US 8,094,104 B2
(45) Date of Patent: Jan. 10, 2012

(54) SEMICONDUCTOR INTEGRATED CIRCUIT, LIQUID CRYSTAL DRIVE DEVICE, AND LIQUID CRYSTAL DISPLAY SYSTEM

(75) Inventors: Arata Kinjo, Tachikawa (JP); Kazuo Ookado, Kokubunji (JP); Kouichi Kotera, Kokubunji (JP); Hitoshi Oda, Kokubunji (JP); Masuhiro Endo, Kunitachi (JP)

(73) Assignees: Hitachi ULSI Systems Co., Ltd., Tokyo (JP); Renesas Electronics Corporation, Kawasaki-shi (JP)

( * ) Notice: Subject to any disclaimer, the term of this patent is extended or adjusted under 35 U.S.C. 154(b) by 1194 days.

(21) Appl. No.: 11/833,704

(22) Filed: Aug. 3, 2007

(65) Prior Publication Data

US 2007/0279358 A1 Dec. 6, 2007

Related U.S. Application Data

(62) Division of application No. 10/433,666, filed as application No. PCT/JP01/09356 on Oct. 25, 2001, now Pat. No. 7,405,732.

(30) Foreign Application Priority Data

Dec. 7, 2000 (JP) ..... 2000-372863

(51) Int. Cl.
*G09G 3/36* (2006.01)

(52) U.S. Cl. ..... 345/87; 345/211; 345/55; 345/63

(58) Field of Classification Search ..... 345/87, 345/211, 55, 63
See application file for complete search history.

(56) References Cited

U.S. PATENT DOCUMENTS

| | | | | |
|---|---|---|---|---|
| 5,352,943 | A | 10/1994 | Tsukahara et al. | |
| 5,801,564 | A | 9/1998 | Gasparik | |
| 5,987,543 | A * | 11/1999 | Smith | 710/70 |
| 6,154,069 | A | 11/2000 | Ebihara | |
| 6,243,817 | B1 * | 6/2001 | Melo et al. | 713/300 |
| 6,480,180 | B1 * | 11/2002 | Moon | 345/98 |

(Continued)

FOREIGN PATENT DOCUMENTS

JP 4-348385 A 12/1992

(Continued)

OTHER PUBLICATIONS

Office Action dated Mar. 14, 2008, from counterpart Chinese Appln. No. 01820203.9.

*Primary Examiner* — Richard Hjerpe
*Assistant Examiner* — Leonid Shapiro
(74) *Attorney, Agent, or Firm* — Miles & Stockbridge P.C.

(57) ABSTRACT

A liquid crystal drive device having a differential-type input circuit including a differential amplification stage for receiving a differential signal and a buffer stage for generating an output signal on the basis of an output of the differential amplification stage, the liquid crystal drive device for receiving a signal of display data via the input circuit and outputting a signal for driving a liquid crystal panel on the basis of the display data, wherein a liquid crystal driving voltage VLCD larger than a power supply voltage VCC for logic to be supplied to the operation voltage buffer stage is supplied to the differential amplification stage of the input circuit. A standby function of interrupting an operation current of the differential amplification stage in a period where no display data is received is provided.

6 Claims, 18 Drawing Sheets

U.S. PATENT DOCUMENTS

2004/0227544 A1 11/2004 Yin et al.

FOREIGN PATENT DOCUMENTS

JP 5-48349 A 2/1993
JP 5-313609 A 11/1993
JP 6-337655 A 12/1994
JP 8-293745 A 11/1996
JP 09-219636 8/1997
JP 9-219636 A 8/1997
WO WO 93/00739 A1 1/1993

* cited by examiner

Vref=2.4V, -30°C
Vref=2.4V, 25°C
Vref=2.4V, 75°C
Vref=1.2V, -30°C
Vref=1.2V, 25°C
Vref=1.2V, 75°C
Vref=0.5V, -30°C
Vref=0.5V, 25°C
Vref=0.5V, 75°C

SEMICONDUCTOR INTEGRATED CIRCUIT, LIQUID CRYSTAL DRIVE DEVICE, AND LIQUID CRYSTAL DISPLAY SYSTEM

CROSS-REFERENCE TO RELATED APPLICATION

This application is a division of application Ser. No. 10/433,666 filed Dec. 24, 2003, now U.S. Pat. No. 7,405,732 which is a 371 of PCT/JP01/09356 filed Oct. 25, 2001.

TECHNICAL FIELD

The present invention relates to a technique useful for application to a semiconductor integrated circuit having a differential circuit such as a small amplitude differential signal interface and, further, a technique which is particularly useful for a semiconductor integrated circuit for receiving two kinds of power supplies such as a liquid crystal driver.

BACKGROUND ART

Liquid crystal drivers for driving a data line of a TFT (Thin Film Transistor) liquid crystal panel used as a display in a notebook-sized computer or the like include a liquid crystal driver for receiving digital display data of 6 bits per pixel at high speed and generating 384 liquid crystal driving output voltages in 64 tones on the basis of the digital data. In recent years, as a interface for transmitting/receiving digital data at high speed in such a liquid crystal driver, an LVDS (Low Voltage Differential Signaling) interface or a small amplitude differential signal interface as a derivative standard of the LVDS interface is used. By using such a small amplitude differential signal interface, as compared with the case of applying a CMOS level interface or the like, power consumption and electromagnetic interference (EMI) of input/output signals can be reduced.

FIG. 5 is a circuit diagram of an MOSFET as an example of a small amplitude differential signal interface examined by the inventors herein and the like before achieving the present invention.

The small amplitude differential signal interface includes, for example as shown in FIG. 5, a differential amplification stage 61 for amplifying a difference voltage of input differential signals, a driving stage 62 for increasing an output voltage from the differential amplification stage 61 by a level shifting circuit 62*a* and for generating a signal on the output side on the basis of the output voltage, and an output stage 63 for driving a load connected to the output side and outputting a signal of a predetermined amplitude. The differential amplification stage 61 has a constant current MOSFET Q61 which is connected to a common source of a pair of differential input MOSFETs Q62 and Q63 and supplies constant current. A direct current flowing in the differential amplification stage 61 is controlled by the constant current MOSFET Q61.

For a small amplitude differential signal interface or a semiconductor chip having the interface, there are a request for a wider fluctuation permissible width of a center voltage of input differential signals and a request for lower power consumption by decreasing a power supply voltage for logic which is supplied to the semiconductor chip.

However, in the small amplitude differential signal interface, a power supply voltage VCC for logic supplied to the driving stage 62 and the output stage 63 is commonly supplied to the source of the constant current MOSFET Q61 provided for the differential amplification stage 61. Therefore, when the power supply voltage VCC is decreased, a gate-source voltage Vgs of the MOSFET Q61 for constant current also decreases.

A drain current in a saturation region in an MOSFET is expressed by the following equation (1).

$$I=\beta(W/L)(Vgs-Vth)^2 \quad (1)$$

where β denotes a constant, W denotes a gate width, L indicates a gate length, and Vth indicates a threshold voltage.

As understood also from Equation (1), if the gate-source voltage Vgs decreases, a problem such that when the threshold voltage Vth is deviated from a reference value due to variation in process of the MOSFET, the variation exerts a large influence on the current value I and a problem such that a gate width has to be increased to pass the same current occur.

When the power supply voltage VCC is lowered, the potential of the common source of the differential input MOSFETs Q62 and Q63 also decreases. A current passed to the differential amplification stage 61 also relatively largely changes due to fluctuations in the center voltage of input differential signals YP and YN and current consumption and circuit characteristics change. It causes a problem such that the fluctuation permissible width of the center voltage of the input differential signals YP and YN cannot be also widened.

Further, when the potential of the common source of the differential input MOSFETs Q62 and Q63 decreases, the output voltage from the differential amplification stage becomes low and a problem such that the level shifting circuit 62*a* has to be provided for the driving stage 62 at the post stage. However, a direct current has to be passed to the level shifting circuit 62*a*, so that current consumption increases accordingly. It is therefore generally designed so that the direct current passed to the level shifting circuit 62*a* becomes small. When designed in such a manner, however, the rising of a signal in the level shifting circuit 62*a* becomes slow, and a problem such that signal delay time increases occurs.

From the above, it was found that, in the semiconductor integrated circuit having an input circuit as shown in FIG. 5, the power supply voltage VCC for logic cannot be set to be too low. As a result, there is a problem such that the power consumption of the semiconductor chip cannot be reduced.

An object of the invention is to provide a semiconductor integrated circuit and a liquid crystal drive device having a differential circuit capable of realizing a wider fluctuation permissible width of a center voltage of input differential signals and reducing power consumption.

Another object of the invention is to provide a semiconductor integrated circuit and a liquid crystal drive device realizing a wider fluctuation permissible width of a center voltage of input differential signals and lower power consumption by decreasing a power supply voltage for logic.

The above and other objects and novel features of the invention will become apparent from the description of the specification and the attached drawings.

DISCLOSURE OF THE INVENTION

The summary of representative inventions in inventions disclosed in the specification will be described as follows.

A semiconductor integrated circuit comprising a differential circuit including a differential amplification stage which has a pair of differential MOS transistors whose sources be commonly connected to each other and a MOS transistor for constant current connected between the common source of the pair of differential MOS transistors and a power supply voltage terminal and amplifies a differential input signal, and an output stage for generating an output signal on the basis of a voltage output from one of output terminals of the differential amplification stage, wherein a second power supply voltage which is higher than a first power supply voltage supplied to the output stage is supplied to the power supply voltage terminal of the differential amplification stage.

By such means, a gate-source voltage Vgs of the MOS transistor for constant current can be increased by the second power supply voltage larger than the first power supply voltage. As understood from the equation (1), an influence of variation in the threshold voltage Vth of the transistor on the current can be reduced and, further, the size of a transistor for passing the same current can be reduced.

Since the voltage on the drain side of the MOS transistor for constant current can be also increased, fluctuation in the current due to a change in the center voltage of input differential signals can be also suppressed. Therefore, a circuit having a wider fluctuation permissible width of the center voltage, in which the current consumption and circuit characteristics are not changed by fluctuation in the center voltage of input differential signals YP and YN can be realized.

Since the voltage on the drain side of the MOS transistor for constant current can be also increased, an output voltage from the differential amplification stage can be made high and it becomes unnecessary to provide a level shifting circuit at the post stage. Thus, a direct current flowing in the level shifting circuit is eliminated so that power consumption can be reduced. Since the level shifting circuit becomes unnecessary, the rising edge of signals can be prevented from being delayed and signal delay time can be shortened.

A semiconductor integrated circuit according to the invention comprises: an input circuit for receiving a pair of differential signals input from the outside and supplying a signal according to a voltage difference between the differential signals to an internal logic circuit; the internal logic circuit for receiving the signal from the input circuit and performing logic operation; and an output circuit for outputting a signal having an amplitude larger than that of a signal of the internal logic circuit to the outside, a first power supply voltage being supplied to the internal logic circuit and a second power supply voltage higher than the first power supply voltage being supplied to the output circuit, wherein the input circuit comprises: a differential amplification stage having a pair of differential MOS transistors whose sources be commonly connected to each other and a transistor for constant current connected between the common source of the pair of differential MOS transistors and a power supply voltage terminal and amplifying a differential input signal; and an output stage for generating the output signal on the basis of a voltage output from one of output terminals of the differential amplification stage, and the second power supply voltage is supplied to the power supply voltage terminal of the differential amplification stage.

By such means, the second power supply voltage is supplied to the differential amplification stage, so that the fluctuation permissible width of the center voltage of differential signals to be input to the input circuit can be widened and, by setting the first power supply voltage for logic to be low, power consumption can be reduced. Since the power supply used for outputting a high-voltage signal in the output circuit is also used as the second power supply voltage higher than the first power supply voltage, it is unnecessary to prepare a new power supply voltage for the differential amplification stage. Even in the case of passing a predetermined direct current, the size of the transistor of the differential amplification stage can be reduced, so that the chip area is not increased.

Concretely, in a semiconductor integrated circuit for driving liquid crystal in which digital data of each pixel as a differential signal is input to the input circuit and a drive voltage for driving a liquid crystal panel is generated on the basis of the digital data and output from the output circuit, the power supply voltage for driving the liquid crystal panel is used as the second power supply voltage.

Concretely, the transistor for constant current is a P-channel MOS transistor for flowing constant current having a gate to which a bias voltage is applied.

The differential amplification stage has two differential input P-channel MOS transistors whose sources are commonly connected to each other and whose gates receive the pair of differential signals, and the common source of the two differential input P-channel MOS transistors is connected to the drain of the P-channel MOS transistor for constant current.

In a liquid crystal display system according to the invention, standby means for interrupting operation current flowing in a differential amplification stage is provided in a differential input circuit for inputting display data. According to such means, a current vainly flowing in the differential amplification stage can be interrupted and the power consumption can be further decreased.

Desirably, interruption of an operation current by the standby means is canceled on the basis of an external signal indicative of a timing at which a plurality of pieces of display data are continuously transferred and interruption of the operation current by the standby means is started on the basis of detection of completion of input of the display data continuously transferred.

With such a configuration, it is unnecessary to input a new signal from the outside for controlling the standby means. Without changing the conventional system of input/output signals to be received/transmitted from/to the outside, a current control of the differential amplification stage can be performed.

Desirably, two clock input circuits are provided, for inputting differential external clocks so that a positive phase side and a negative phase side are opposite to each other in the case where two input signals are serially input per external clock to the input circuit. Timings of receiving the two input signals may be provided on the basis of two clock signals input via the two clock input circuits.

With such a configuration, even when conditions such as manufacture variations of semiconductors, the center voltage of differential external clocks, power supply voltage, temperature and the like change to a certain degree, it does not exert an influence as a variation of the clock signal which provided the timing of receiving an input signal. Thus, the timing of latching display data can be easily adjusted.

BRIEF DESCRIPTION OF THE DRAWINGS

FIG. 5 is a circuit diagram showing an example of a small amplitude differential signal interface examined by the inventors herein and the like.

BEST MODE FOR CARRYING OUT THE INVENTION

Preferred embodiments of the invention will be described hereinbelow with reference to the drawings.

First Embodiment

Figure 1:
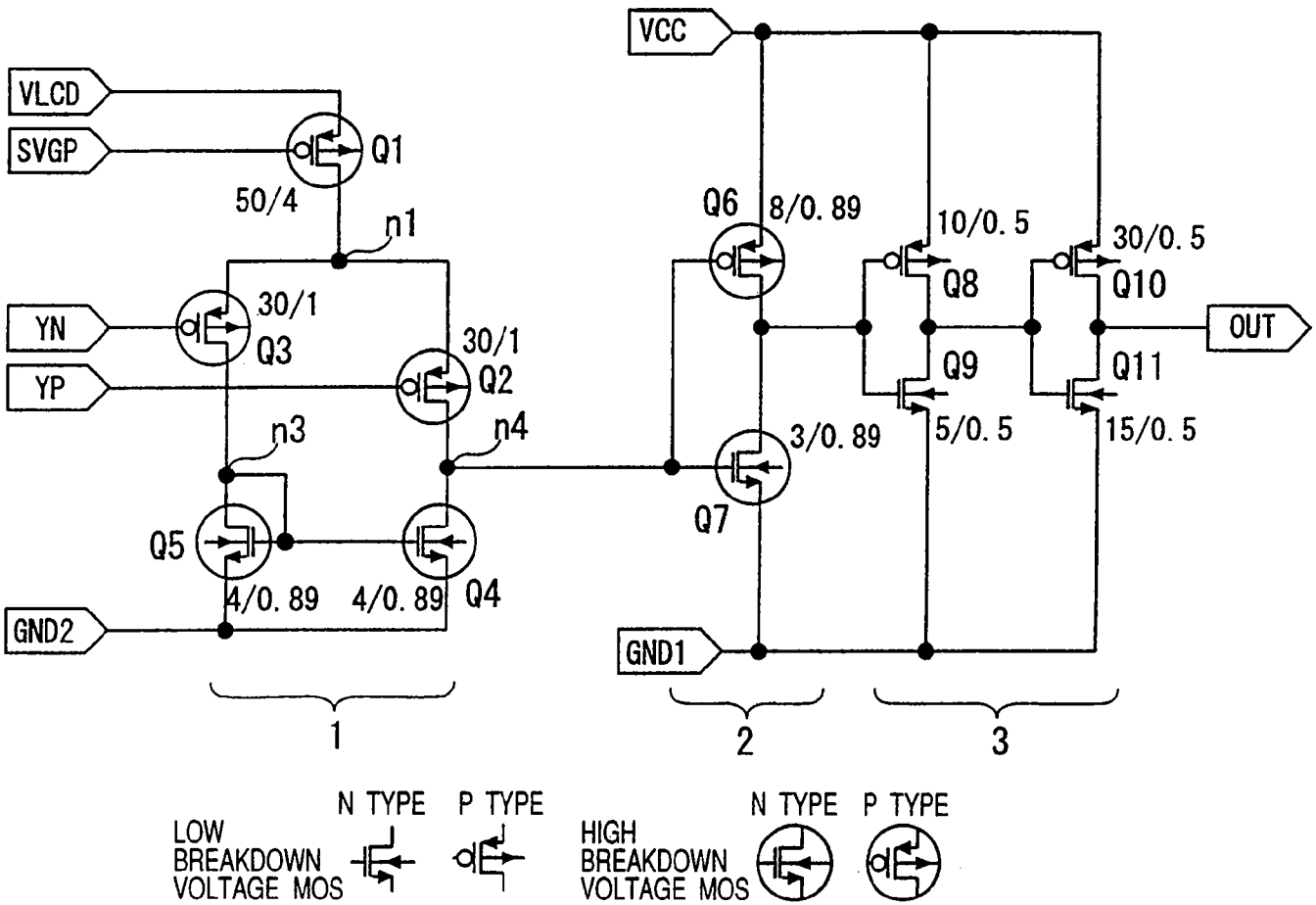
FIG. 1 is a circuit diagram showing an example of a small amplitude differential signal interface to which the invention is suitably applied.

FIG. 1 is a circuit diagram specifically showing an example of a small amplitude differential signal interface to which the invention is suitably applied. In the diagram, beside each MOSFET, the ratio "W/L" of gate width W(μm) and gate length L (μm) as an example of a preferable numerical value is shown.

A small amplitude difference signal interface (differential input circuit) of the embodiment is an LVDS (Low Voltage Differential Signaling) interface or a small amplitude differential signal interface as a derivative technique of the LVDS interface specified in IEEE (Institute of Electrical and Electronics Engineers). For example, the interface receives a small amplitude differential signal (having an amplitude of 200 mV to 500 mV) input from the outside such as an external clock and a data signal and outputs a high-level or low-level signal to an internal circuit in accordance with a voltage difference between a pair of small amplitude differential signals.

As shown in FIG. 1, the small amplitude differential signal interface includes: a differential amplification stage 1 constructed by a pair of differential input MOSFETs Q2 and Q3, an MOSFET Q1 for constant current connected to a common source of the differential input MOSFETs Q2 and Q3, and active load MOSFETs Q4 and Q5 connected to drains of the differential input MOSFETs Q2 and Q3, and a driving stage 2 and an output stage 3 for receiving an amplified output from the differential amplification stage 1 and outputting a high-level or low-level signal in accordance with the output voltage.

To the driving stage 2 and the buffer stage 3 in the circuit of the embodiment, a power supply voltage VCC (for example, 2.7V to 3.6V) for logic is supplied. On the other hand, to the differential amplification stage 1, a power supply voltage VLCD (for example, 6V to 10V) for driving liquid crystal higher than the power supply voltage VCC for logic is supplied as the power supply voltage. To the gate of the MOSFET Q1 for constant current, a voltage SVGP for current control (for example, 1.6V to 1.8V) generated by a constant voltage circuit and a bias circuit is applied. A bias current is supplied to the common source side of the differential input MOSFETs Q2 and Q3 by the operation of the saturation region of the MOSFET.

Figure 5:
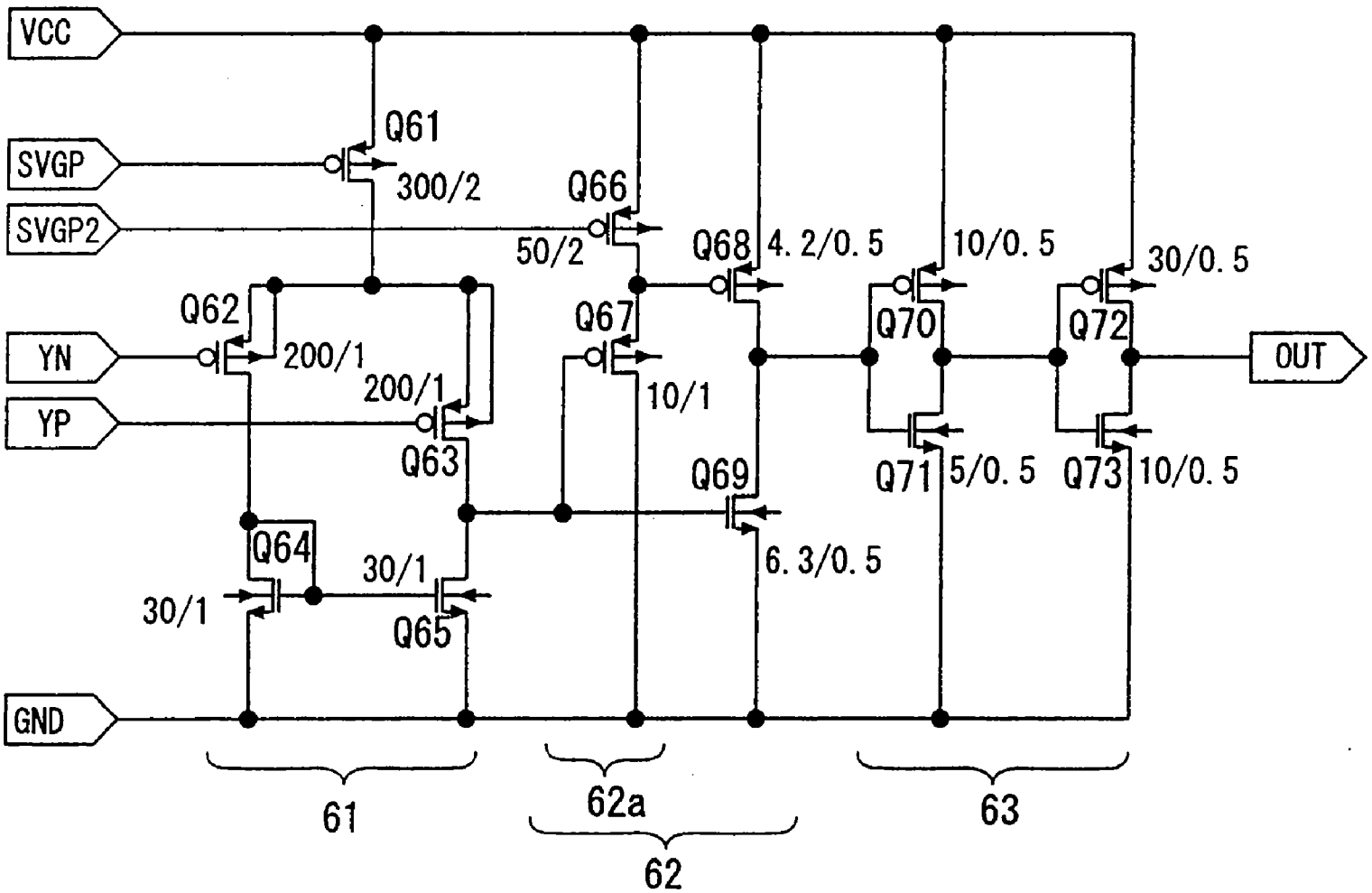

By the power supply voltage VLCD for driving liquid crystal, the gate-source voltage Vgs of the MOSFET Q1 for constant current becomes larger as compared with that in the circuit form of FIG. 5. Therefore, as also understood from the current expression $I=\beta(W/L)(Vgs-Vth)^2$ in the saturation state of the MOSFET, even if the threshold voltage Vth is deviated from the reference value a little due to variations in process of the MOSFET, a large influence is not exerted on the drain current value. Since the gate-source voltage Vgs is relatively large, even if the gate width W of the MOSFET is not increased so much, a desired current value is obtained.

Further, the voltage of a node n1 to which the source terminals of the differential input MOSFETs Q2 and Q3 are connected also increases. Consequently, even if the center voltage of the input differential signals YP and YN fluctuates a little, the current passed to the differential amplification stage 1 does not change so much, and current consumption and circuit characteristics are constant. Therefore, the fluctuation permissible width of the center voltage of the input differential signals YP and YN can be widened.

Since the voltage of the common source of the differential input MOSFETs Q2 and Q3 becomes high, the high-level voltage output to an output node n2 of the differential amplification stage 1 becomes high enough to turn on a P-channel MOSFET Q6 of the driving stage 2. Consequently, the level shifting circuit 62*a* as that provided for the conventional small amplitude differential signal interface shown in FIG. 5 can be eliminated. Therefore, the power consumption can be decreased by the amount for the level shifting circuit and a signal delay can be also reduced.

Since the high power source voltage VLCD is supplied to the differential amplification stage 1, each of MOSFETs as components of the differential amplification stage 1 and the driving stage 2 which receives an output of the differential amplification stage 1 by its gate is preferably a MOSFET of high breakdown voltage (for example, high breakdown voltage of 7V).

The characteristics of the small amplitude differential signal interface will now be described quantitatively.

Figure 3:
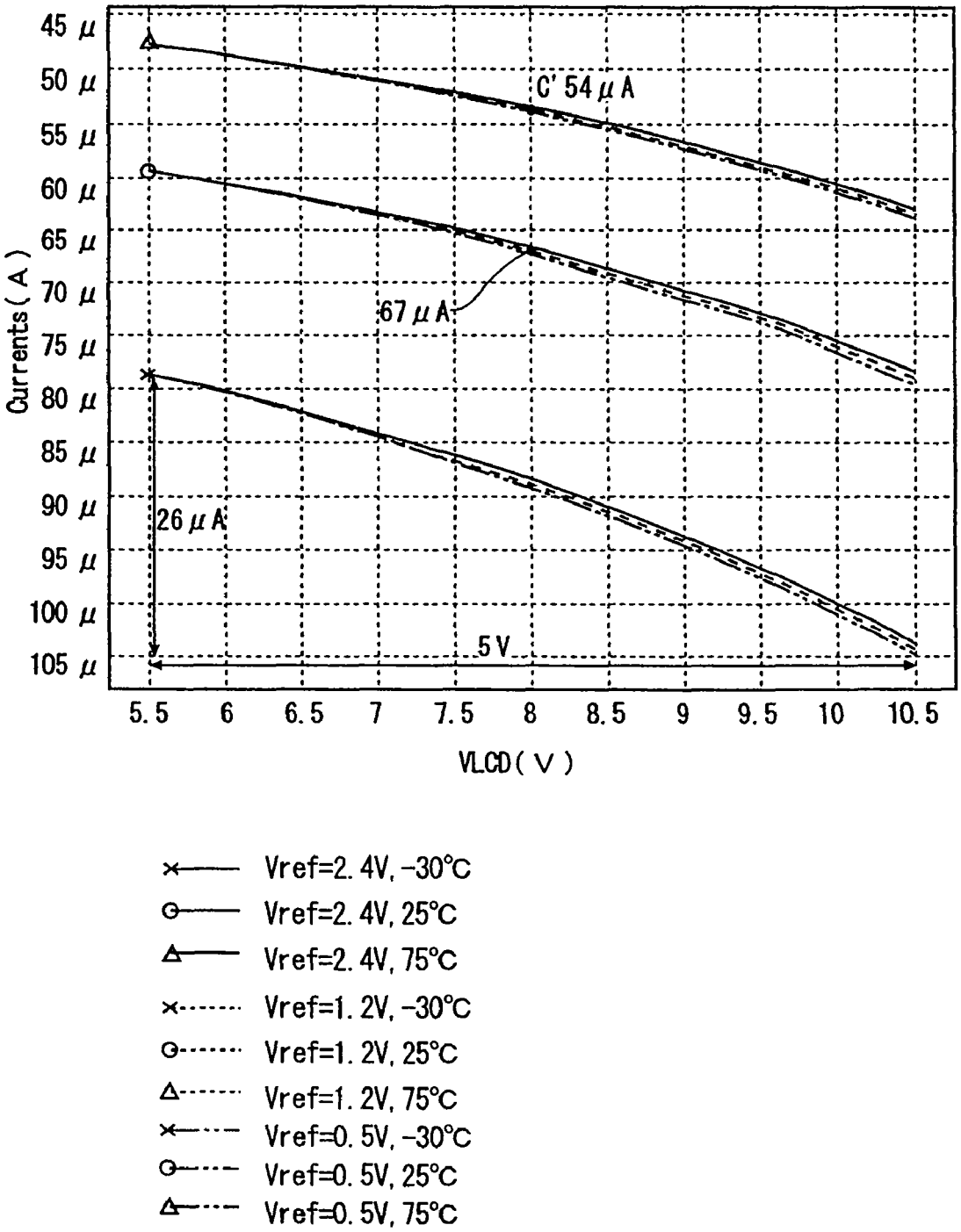
FIG. 3 is a characteristic graph of the small amplitude differential signal interface of FIG. 1 in the case where a threshold voltage Vth of an MOSFET is generated to be high in both a P-channel and an N-channel.
Figure 4:
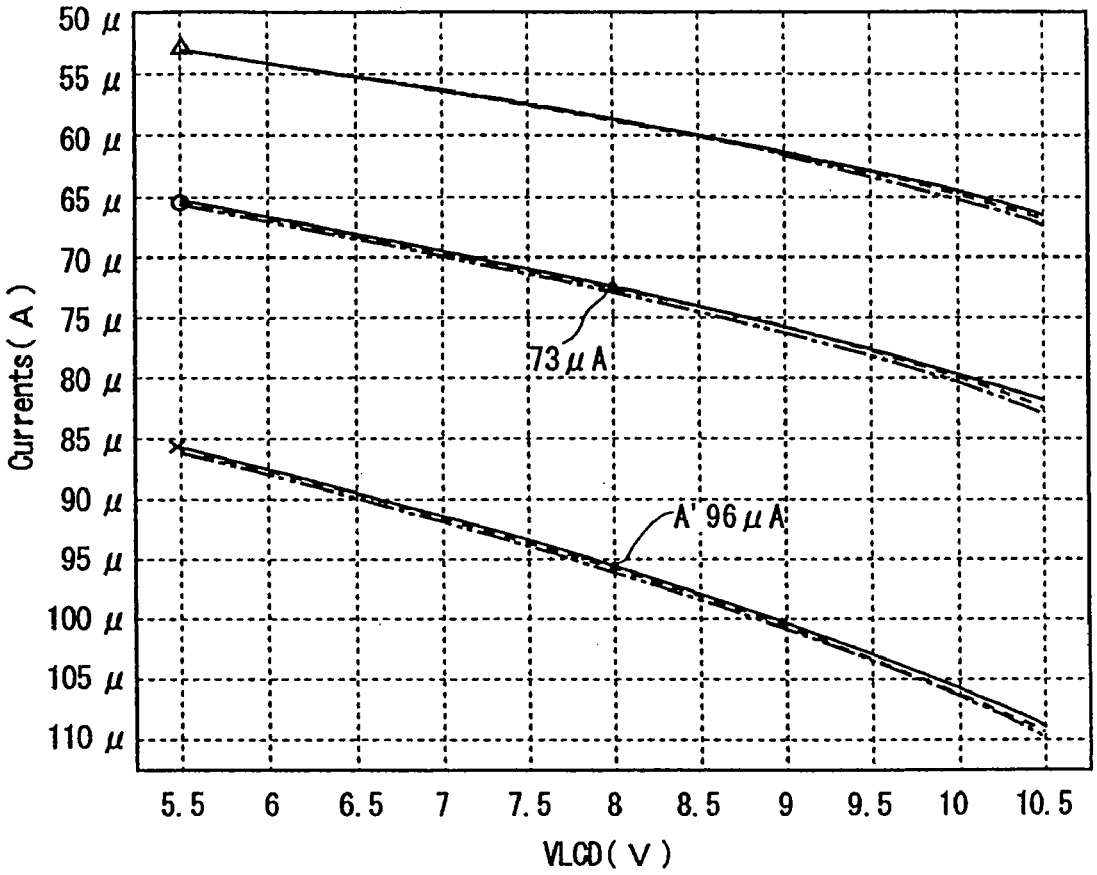
FIG. 4 is a characteristic graph of the small amplitude differential signal interface of FIG. 1 in the case where the threshold voltage Vth of an MOSFET is generated to be low in both a P-channel and an N-channel.

FIGS. 3 and 4 are graphs showing characteristics of the small amplitude differential signal interface of FIG. 1. FIG. 3 is a graph of a case where the threshold voltage Vth of the MOSFET is generated to be high in both a P-channel type and an N-channel type due to process variations, and FIG. 4 is a graph showing the case where the threshold voltage Vth is generated to be low in both the P-channel type and the N-channel type.

An abscissa in each of the graphs denotes the voltage value of the power supply voltage VLCD supplied to the source of the MOSFET Q1 for constant current and an ordinate denotes the value of a direct current passed to the differential amplification stage 1. Graph lines indicate cases where the center voltages Vref of input differential signals are 0.5V, 1.2V, and 2.4V and chip temperatures are −30° C., 25° C., and 75° C.

A characteristic change due to process variations, a characteristic change due to the center voltage Vref of the input differential signals, and a characteristic change due to the power supply voltage VLCD will be described hereinbelow one after another.

A change amount of the current value due to process variations is lower than 10%. For example, under conditions of chip temperature of 25° C., liquid crystal driving voltage VLCD of 8V, and the center voltage of input differential signals of 1.2V, when the threshold voltage Vth is generated high in FIG. 3, current value of 67 μA is obtained. On the other hand, when the threshold voltage Vth is generated low in FIG. 4, current value of 73 μA is obtained. The difference between the values is less than 10%. It is understood from the graphs that the change amount of the current value due to the process variations is the same irrespective of the chip temperature, the liquid crystal driving voltage VLCD, and the center voltage of the input differential signals.

Changes of the center voltage Vref of the input differential signals are indicated by solid lines, dotted lines, and alternate long and two short dashes lines in the graphs of FIGS. 3 and 4. It is understood from the graphs that a deviation of the current value hardly occurs due to variations in the center voltage Vref of the input differential signals when the characteristics of the chip temperature and the threshold voltage Vth are the same.

The change in the current value due to the power supply voltage VLCD is 26 μA/5V in the case where it is large (the case in which the threshold voltage Vth is generated to be high and the chip temperature is −30° C. in FIG. 3). It is 20 μA to 17μ/5V in a standard case (chip temperature of 30° C.). The change amount is small. Consequently, even when the interface is designed so as to operate with the minimum current, the maximum current does not become extremely high and low current consumption can be achieved.

Figure 6:
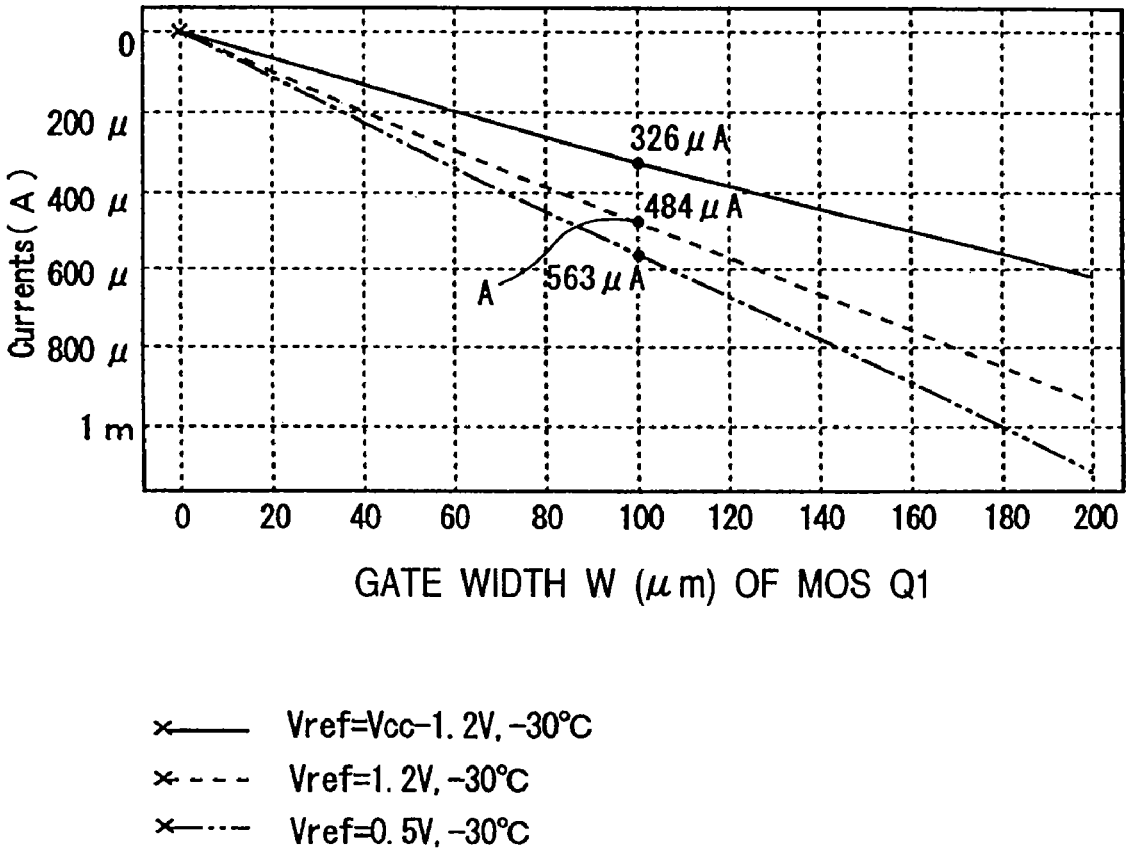
FIG. 6 is a characteristic graph of the small amplitude differential signal interface of FIG. 5 when the threshold voltage Vth of the MOSFET is generated to be low in both a P-channel and an N-channel.
Figure 7:
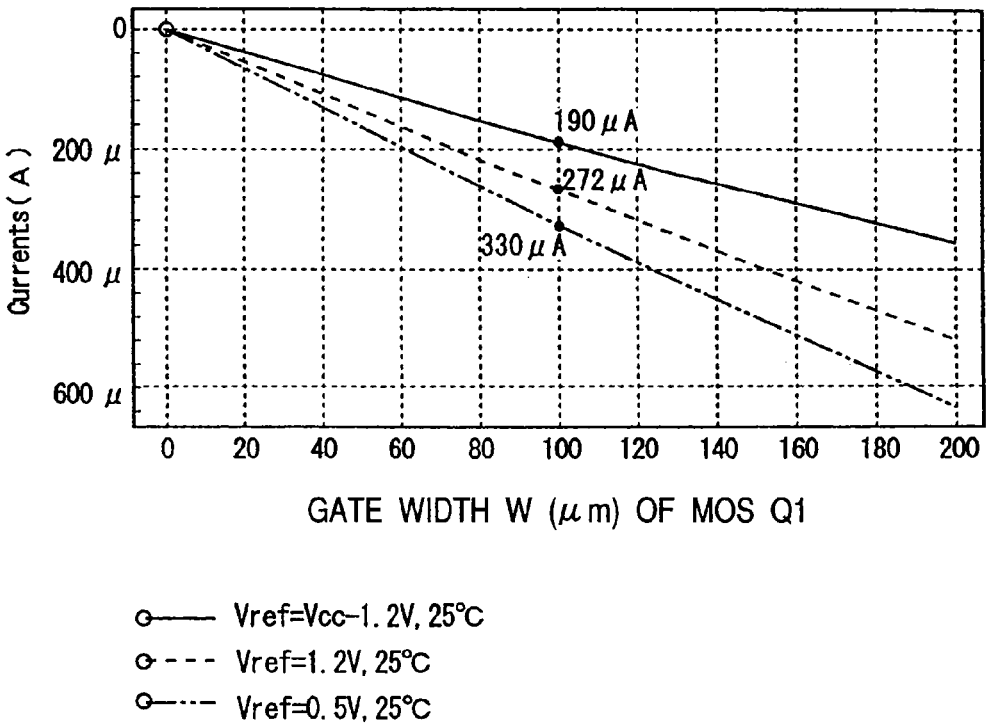
FIG. 7 is a characteristic graph of the small amplitude differential signal interface of FIG. 5 when the threshold voltage Vth of the MOSFET is generated as a reference value in both a P-channel and an N-channel.
Figure 8:
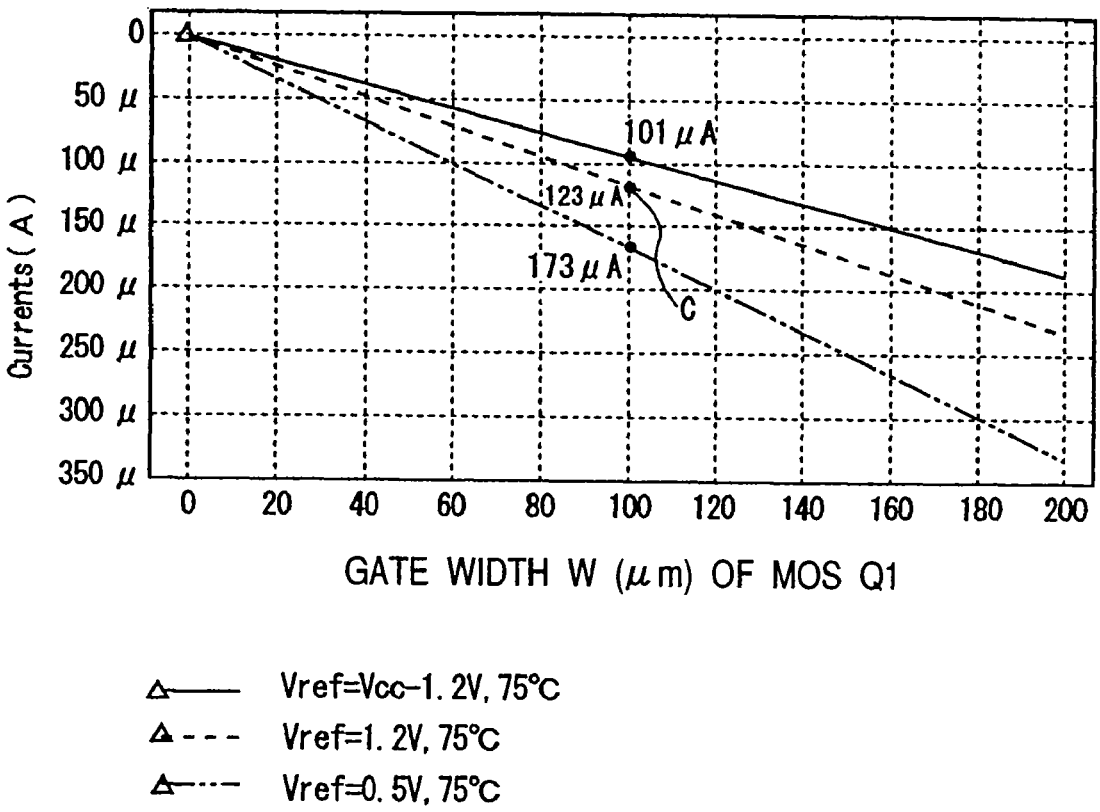
FIG. 8 is a characteristic graph of the small amplitude differential signal interface of FIG. 5 when the threshold voltage Vth of the MOSFET is generated to be high in both a P-channel and an N-channel.

FIGS. 6 to 8 show characteristics graphs of the conventional small amplitude differential signal interface of FIG. 5. FIG. 6 shows the case where the threshold voltage Vth of the MOSFET is generated to be low in both the P and N channels and the power supply voltage VCC is 3.6V at the maximum. FIG. 7 shows the case where both of the threshold voltage Vth and the power supply voltage VCC are reference values. FIG. 8 shows the case where the threshold voltage Vth is generated to be high in both of the P and N channels and the power supply voltage VCC is 2.7V at the minimum.

In the graphs, the abscissa shows the gate width W of the MOSFET Q1 for constant current, and the ordinate indicates the value of a direct current passed to the differential amplification stage 1. Graph lines indicate the cases where the center voltage Vref of the input differential signals are 0.5V, 1.2V, and VCC-1.2V.

In the conventional small amplitude differential signal interface, when the gate width W of the MOSFET Q1 for constant current is set to 100 μm and the center voltage Vref of the input differential signals changes by 0.5 to VCC-1.2V, the current value in the case of FIG. 6 is 563 μA to 326 μA which is a change amount of 40% or higher. Similarly, in the case of FIG. 7 as well, the current value is 330 μA to 190 μA and the change amount is 40% or higher. In the case of FIG. 8 as well, the current value is 173 μA to 101 μA and the change amount is 40% or higher.

When the condition is that the center voltage of the input differential signals is constant (Vref=1.2V) and the other conditions change to the maximum, that is, when it is changed from the conditions where the threshold voltage Vth of the MOSFET is the minimum, the power supply voltage VCC is the maximum of 3.6V, and the chip temperature is −30° C. (point A in FIG. 6) to the conditions where the threshold voltage Vth of the MOSFET is the maximum, the power supply voltage VCC is the minimum of 2.7V, and the chip temperature is 75° C. (point C in FIG. 6), the current value drops from 484 μA to 123 μA which is 74%. In the case of designing the interface so that the operation can be assured under the current minimum condition, the maximum current becomes extremely high so that low current consumption cannot be achieved.

When the characteristics of the small amplitude differential signal interface of FIG. 1 of the embodiment are considered under substantially the same conditions, it is understood that drop in the current value is suppressed from 96 μA to 54 μA, which is 43% also when the conditions where the threshold voltage Vth of the MOSFET is the minimum and the chip temperature is −30° C. (point A' in FIG. 4) to the conditions where the threshold voltage Vth of the MOSFET is the maximum and the chip temperature is 75° C. (point C' in FIG. 3).

As described above, the small amplitude differential signal interface of the embodiment is constructed so as to supply the liquid crystal drive voltage VLCD higher than the power supply voltage VCC for logic to the differential amplification stage 1. Thus, the threshold voltage Vth of the MOSFET, the center voltage Vref of the input differential signals, and the power supply voltage VLCD change a little due to process variation, the current value flowing in the differential amplification stage 1 does not fluctuate much, and the characteristics (for example, rise/fall time, output voltage, and the like) of the differential amplification stage 1 can be maintained normally. Therefore, the fluctuation permissible width of the center voltage of the input differential signals can be widened.

An example of applying the small amplitude differential signal interface to the semiconductor integrated circuit which receives two kinds of power supply voltages will be described hereinbelow.

Figure 2:
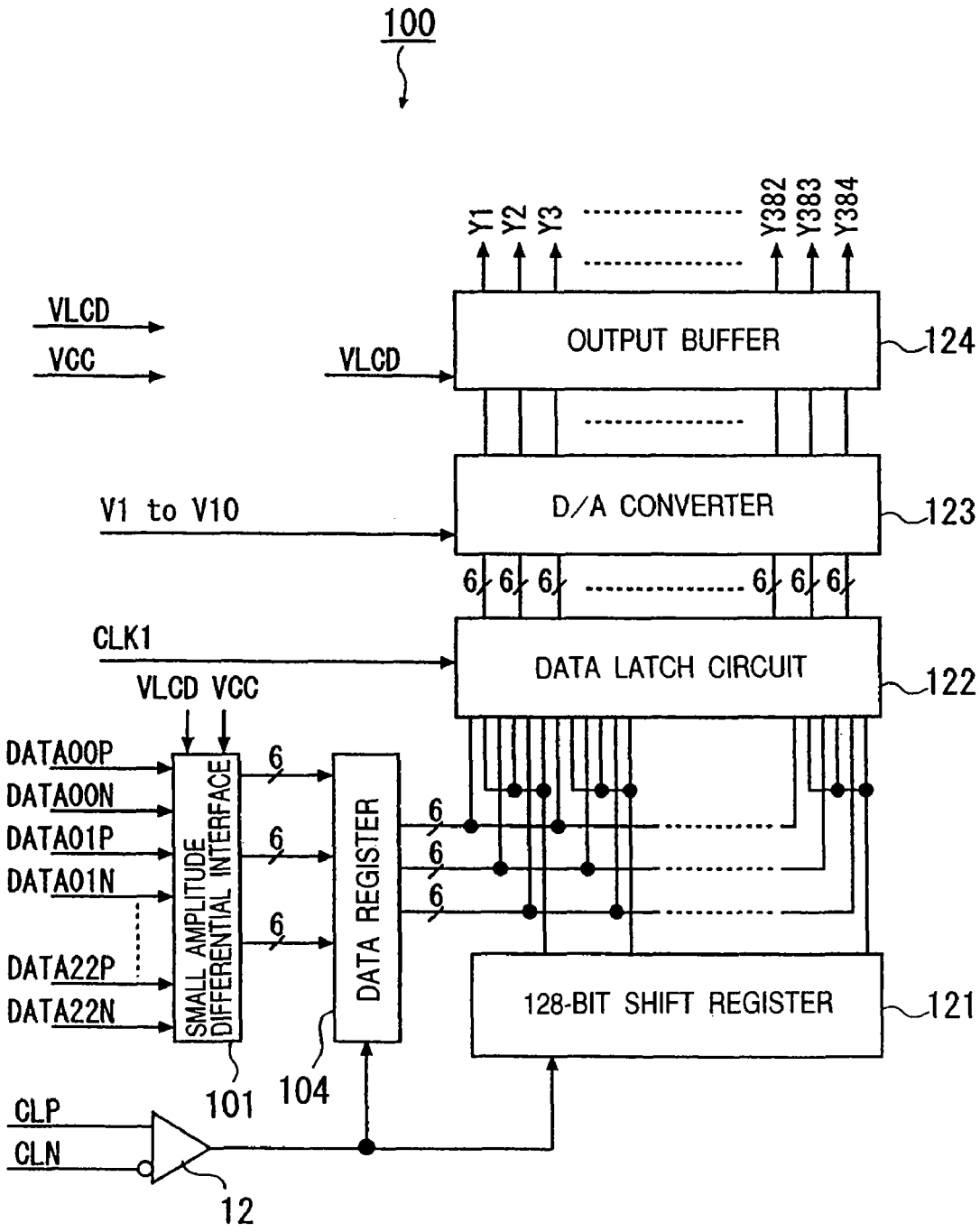
FIG. 2 is a block diagram showing a general configuration of a liquid crystal driver having the small amplitude differential signal interface according to the invention.

FIG. 2 is a block diagram showing the general configuration of a liquid crystal driver having the small amplitude differential signal interface in its signal input section.

A liquid crystal driver 100 as a liquid crystal drive device of the embodiment drives a data line of a TFT liquid crystal panel used as a display of a notebook-sized computer and, but not limited, is formed on a single semiconductor chip made of single crystal silicon or the like.

The liquid crystal driver 100 of the embodiment has an interface 101 which is realized by the small amplitude differential interfaces 101 and 12 for receiving digital display data DATA00P and DATA00N to DATA22P and DATA22N of six bits per pixel input from the outside in the form of small amplitude differential signals and external clocks CLP and CLN. The liquid crystal driver 100 also includes: a data register 104 for temporarily holding input digital data; a data latch circuit 122 for sequential shifting the data held in the data register 104 by predetermined bits and holding data of one line; a shift register 121 for transferring the data in the data register 104 to the predetermined bits in the data latch circuit 122; a D/A converter 123 for converting digital data of one line held in the data latch circuit 121 into an analog signal indicative of tone of each pixel; and an output buffer 124 for generating and outputting drive voltages Y1 to Y384 of data lines of the TFT liquid crystal panel on the basis of analog signals from the D/A converter 123.

To the liquid crystal driver 100, the power supply voltage VCC used as an operation power of internal logic circuits such as the driving stage 2 and the buffer stage 3 of the small amplitude differential signal interface 101, data register 104, shift register 121, and data latch circuit 122 and the power supply voltage VLCD for driving liquid crystal used for generating the liquid crystal driving voltages Y1 to Y384 are supplied from the outside of the chip. The power supply voltage VLCD for driving liquid crystal is divided by a resistive dividing circuit (not shown) or the like into voltages V1 to V10 in plural levels for displaying tone which are supplied to the D/A converter 123 and output buffer 124. The power supply voltage VLCD for driving liquid crystal is supplied also to the differential amplification stage 1 in the small amplitude differential signal interface 101.

In the liquid crystal driver 100, the fluctuation permissible width of the center voltage of the digital display data DATA00P and DATA00N to DATA22P and DATA22N and external clocks CLP and CLN input from the outside can be set wide and the power supply voltage VCC for logic does not exert an influence on the characteristics of the small amplitude differential signal interface 101, so that the power supply voltage VCC can be set to be low. Thus, the semiconductor chip of low power consumption capable of operating at high speed can be realized.

Although the invention achieved by the inventors herein has been described concretely above, the invention is not limited to the foregoing embodiments but can be variously changed without departing from the gist.

For example, although a concrete circuit configuration of the small amplitude differential signal interface has been described, there are known various modifications of the differential amplification stage and the like and the circuit configuration at the post stage of the differential amplification stage can be also variously modified. The interface is constructed not necessarily by MOSFETs but also by bipolar transistors. The values concretely expressed in the embodiments such as the power supply voltage VCC for logic, liquid crystal driving voltage VLCD, and the size of the MOSFET can be also properly changed.

A configuration example of enabling a voltage other than the power supply voltage VLCD for driving liquid crystal to be applied as the power supply voltage supplied to the differential amplification stage 1 in FIG. 1 will now be described. In FIG. 1, the power supply voltage VLCD for driving liquid crystal is connected to the source terminal of the MOSFET Q1 for constant current (FIG. 1). The case where a second power supply voltage VDD2 is connected to the source terminal will be described hereinbelow.

Figure 9:
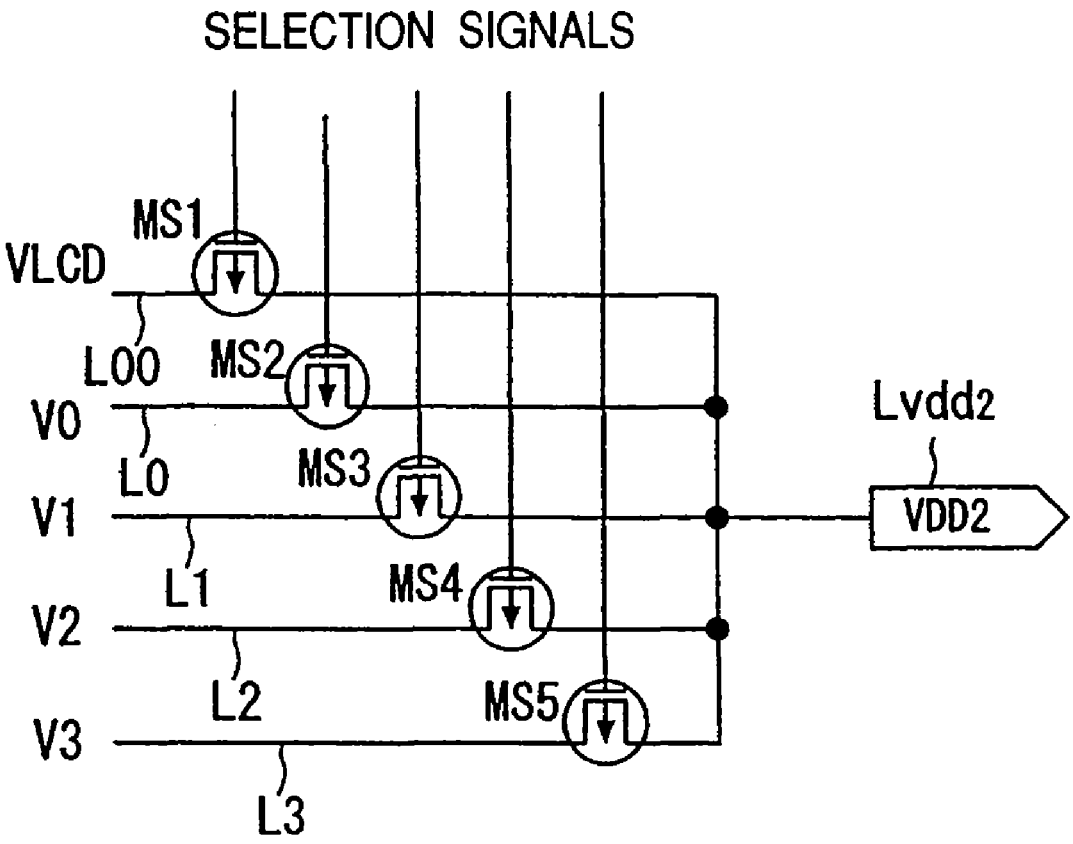
FIG. 9 is a diagram showing an example of the configuration in which a second power supply voltage to be supplied to the small amplitude differential signal interface can be selected from a plurality of power supply voltages.

FIG. 9 is a diagram showing an example of a selection circuit capable of selecting the second power supply voltage VDD2 supplied to the small amplitude differential signal interface from a plurality of voltages.

In the embodiment, as the second power supply voltage VDD2 supplied to the differential amplification stage 1 of the small amplitude differential signal interface 101, any of the power supply voltage VLCD for driving liquid crystal and proper voltages (for example, four voltages from the highest) from the tone voltages V0 to V10 for driving the tone of the liquid crystal supplied from the outside can be selected.

An effect is produced when the power supply voltage VDD2 of the differential amplification stage 1 is higher than the power supply voltage VCC for logic to a certain degree. When the power supply voltage VDD2 is too high, the device breakdown voltage has to be excessively increased, so that power consumption may increase too much. In the embodiment, therefore, any of the tone voltages V0, V1, . . . of which potential is lower than the power supply voltage VLCD for driving the liquid crystal can be selected as the power supply voltage VDD2. When the power supply voltage VLCD is too large, any of the lower tone voltages V0, V1, . . . is applied.

The tone voltages V0 to V10 are resistive-divided at a predetermined ratio in the liquid crystal driver, thereby generating drive voltages of, for example, 64×2 tones. Since the drive voltage varies according to the characteristics of the liquid crystal panel, the tone voltages V0 to V10 are input from the outside and resistive-divided, thereby varying the values of the drive voltage generated internally.

Therefore, since the values of the tone voltages V0 to V10 vary according to a system applied, in the case of applying any of the values as the power supply voltage VVD2, it is convenient to set so that any voltage can be selected from some tone voltages V0, V1, . . . .

In the selection circuit of FIG. 9, switch MOSFETs MS1 to MS5 of high breakdown voltages are provided between a power supply line Lvdd2 of the power supply voltage VDD2 of the differential amplification stage 1 supplied to the small amplitude differential signal interface 101 and power supply lines L00 and L0 to L3 to which the power supply voltage VLCD for driving liquid crystal and tone voltages V0 to V3 are applied, respectively, and are connected each via the source terminal and the drain terminal. A selection signal is supplied to the gate terminal of each of the switch MOSFETs MS1 to MS5.

For example, a dedicated input terminal is provided for the liquid crystal driver and the selection signal is supplied from the outside via the input terminal. Alternately, a control register is provided in the liquid crystal driver and the selection signal is supplied from the control register on the basis of a value set in the control register.

As described above, also in the case where any of the tone voltages V0 to V3 is applied as the power supply voltage VDD2 of the differential amplification stage 1, by widening the fluctuation permissible width of the center voltage of the differential input signals or decreasing the power supply voltage VCC for logic, effects such as higher processing speed of the internal circuits and lower power consumption can be obtained.

Further, in the liquid crystal driver of the embodiment, when the power supply voltage VLCD for driving liquid crystal is very high, any of the tone voltages V0 to V3 lower than the power supply voltage VLCD can be properly selected and used as the power supply voltage VDD2 of the differential amplification stage 1. Consequently, it is unnecessary to excessively increase the device breakdown voltage of the differential amplification stage 1, so that increase in power consumption can be suppressed.

The configuration capable of selecting a voltage as the power supply voltage VDD2 from the power supply voltage VLCD for driving liquid crystal and the tone voltages V0 to V3 is not limited to the configuration using the switch MOSFET but various configurations can be applied.

Figure 10:
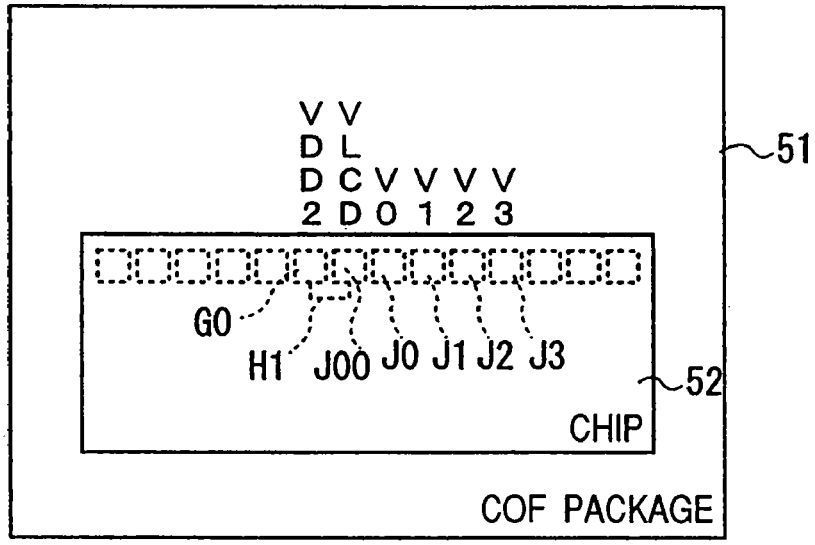
FIG. 10 is a plan view of a COF package showing an example of the configuration where the second power supply voltage can be selected by a line on the COF and illustrates a state where a liquid crystal drive voltage VLCD is selected as the second power supply voltage.
Figure 11:
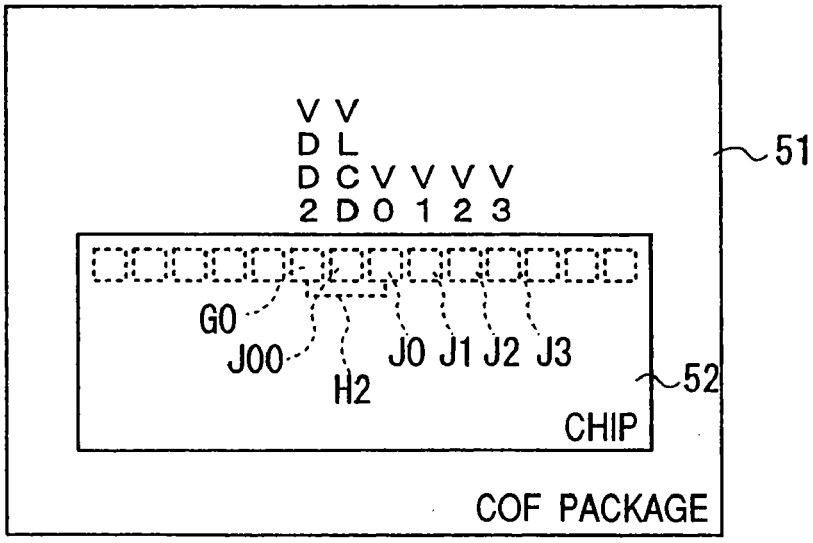
FIG. 11 is a diagram showing a state where a voltage for driving tone is selected as the second power supply voltage in the COF package of FIG. 10.

FIGS. 10 and 11 show configuration examples in which selection of a power supply voltage is enabled by wiring on a wiring film in the case of a COF package.

In the example, as a mounting structure of the liquid crystal driver 100, a COF (Chip on Film) package in which a semiconductor chip 52 as the liquid crystal drive device is mounted on a wiring film 51 is employed. In the example, a connection pad G0 of the second power supply voltage VDD2 is provided for the semiconductor chip 52 on which circuits of the liquid crystal driver 100 are integrated and lines of the wiring film 51 are properly selected, thereby enabling the power supply voltage VDD2 to be selected from any of the power supply voltage VLCD for driving liquid crystal and the tone voltages V0, V1, . . . .

For example, as shown in FIGS. 10 and 11, by connecting the connection pad G0 of the power supply voltage VDD2 to an input pad J00 of the power supply voltage VLCD for liquid crystal driving or any of connection pads J0, J1, . . . of tone voltages V0, V1, . . . via a line H1 or H2 indicated by a dotted line formed on the wiring film 51, any of the power supply voltage VLCD for driving liquid crystal and tone voltages V0, V1, . . . can be selected as the power supply voltage VDD2.

Figure 12:
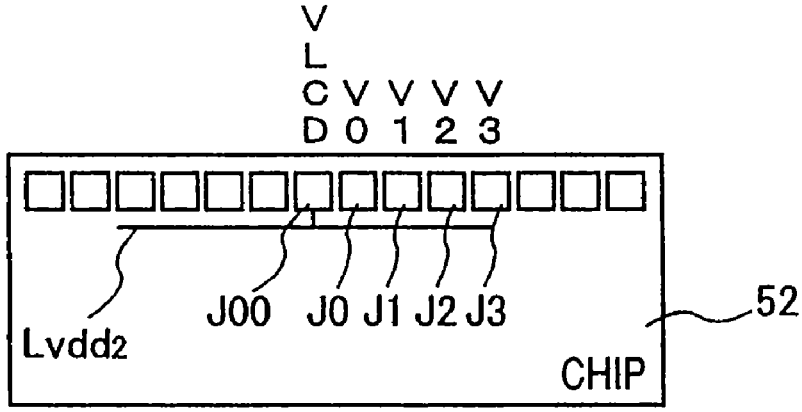
FIG. 12 is a schematic view of a semiconductor chip showing an example of the configuration where the second power supply voltage can be selected in a master slice of an aluminum line and illustrates a state where a liquid crystal drive voltage VLCD is selected as the second power supply voltage.
Figure 13:
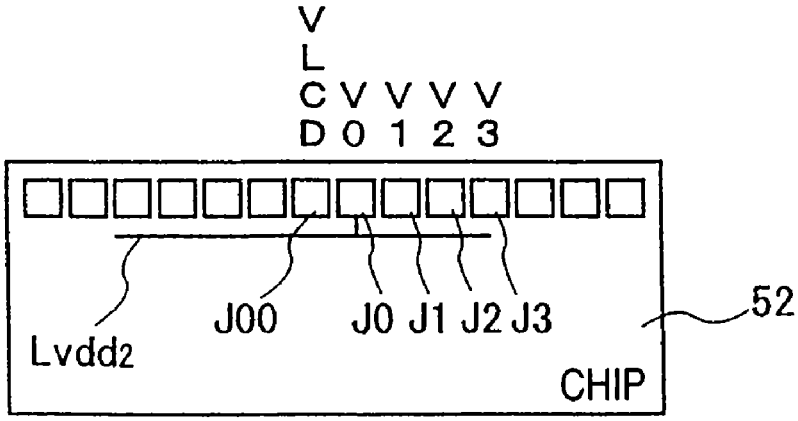
FIG. 13 is a diagram showing a state where the voltage for driving tone is selected as the second power supply voltage in the semiconductor chip of FIG. 12.

FIGS. 12 and 13 show an example of enabling the second power supply voltage VDD2 to be selected by a wiring pattern of a master slice method.

In the example, the power supply voltage VDD2 is selected by a wiring pattern in a process of manufacturing the semiconductor chip 52. As shown in FIGS. 12 and 13, by properly selecting a wiring pattern in which, for example, a power supply line Lvdd2 of the second power supply voltage VDD2 and any of the input pad J00 of the power supply voltage VLCD for driving liquid crystal and input pads J0 to J3 of the tone powers V0, V1, . . . , any of the power supply voltage VLCD for driving liquid crystal and tone voltages V0, V1, . . . can be selected as the second power supply voltage VDD2.

Figure 14:
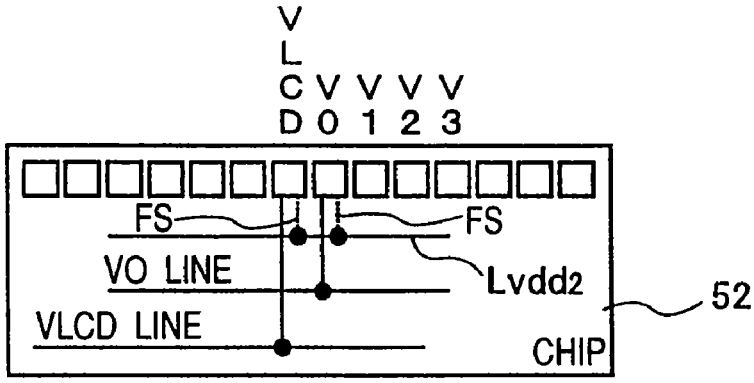
FIG. 14 is a schematic view of a semiconductor chip showing an example of the configuration in which the second power supply voltage can be selected by providing the semiconductor chip with fuses.

FIG. 14 shows a configuration example of enabling the second power supply voltage to be selected by blowing a fuse device provided in the semiconductor chip 52.

In the example, a fuse device FS is provided between the power supply line Lvdd2 of the power supply voltage VDD2 and input pads of the power supply voltage VLCD for driving liquid crystal and the tone voltages V0, V1, . . . . By blowing an unnecessary fuse device at the stage of a wafer, a semiconductor chip, or a package, any of the power supply voltage VLCD for driving liquid crystal and tone voltages V0, V1, . . . can be selected as the second power supply voltage VDD2. The fuse device FS is blown with, for example, a laser or by passing predetermined current with a probe.

Figure 15:
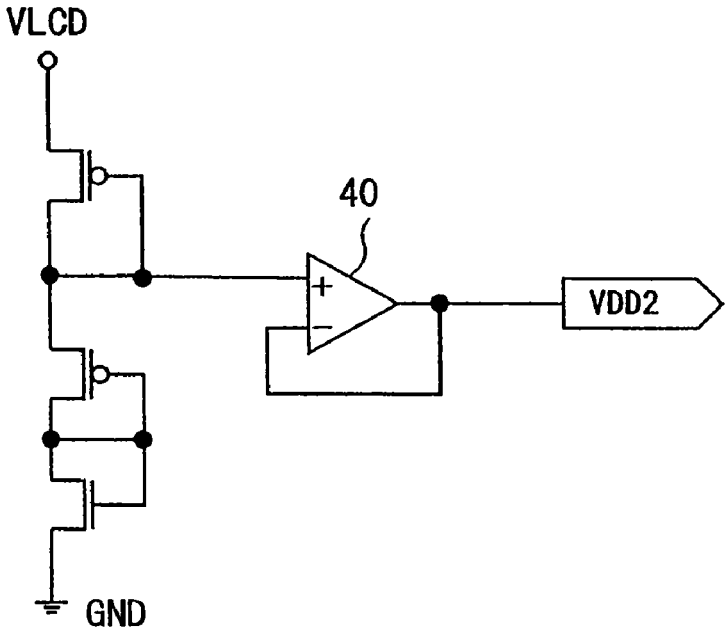
FIG. 15 is a circuit diagram showing an example of a circuit of generating the second power supply voltage to be supplied to the small amplitude differential signal interface.

FIG. 15 shows an example of a circuit for generating the second power supply voltage to be supplied to the small amplitude differential signal interface 101.

In the foregoing example, the example of directly using any of the power supply voltage VLCD for driving liquid crystal and tone voltages V0, V1, . . . as the second power supply voltage VDD2 to be supplied to the differential amplification stage 1 has been described. In this example of FIG. 15, the power supply voltage VLCD for driving liquid crystal is used to generate a voltage lower than the power supply voltage VLCD and the generated voltage is supplied as the second power supply voltage VDD2.

As the voltage generating circuit, various known techniques can be applied. For example, as shown in FIG. 15, it is also possible to resistive-divide the power supply voltage VLCD for driving liquid crystal by resistors R1 and R2 and output a potential obtained by the resistive division via a voltage follower 40.

Although the second power supply voltage VDD2 is generated by using the power supply voltage VLCD in FIG. 15, the tone voltages V0, V1, . . . or a voltage generated from the tone voltages may be used in place of the power supply voltage VLCD.

Second Embodiment

In a second embodiment, a standby function for interrupting, when unnecessary, the operation current of the differential amplification stage 1 in the small amplitude differential signal interface 101 to which the differential display data DATAP and DATAN is input is added to the liquid crystal driver 100 described in the first embodiment. Specifically, the power supply voltages (VLCD, VDD2) of the differential amplification stage 1 in the small amplitude differential signal interface 101 described in the first embodiment are set to be higher than the power supply voltage (VCC) of the internal circuits, so that the consumption power of the differential amplification stage 1 becomes an unignorable value. Since the liquid crystal system is constructed by using, for example, eight liquid crystal drivers 100 of the first embodiment, it is considered that the power consumption of the system is high. In the second embodiment, therefore, the liquid crystal driver 100 capable of reducing power consumption as much as possible by adding the standby function to the differential amplification stage 1 of the first embodiment will be described.

Figure 16:
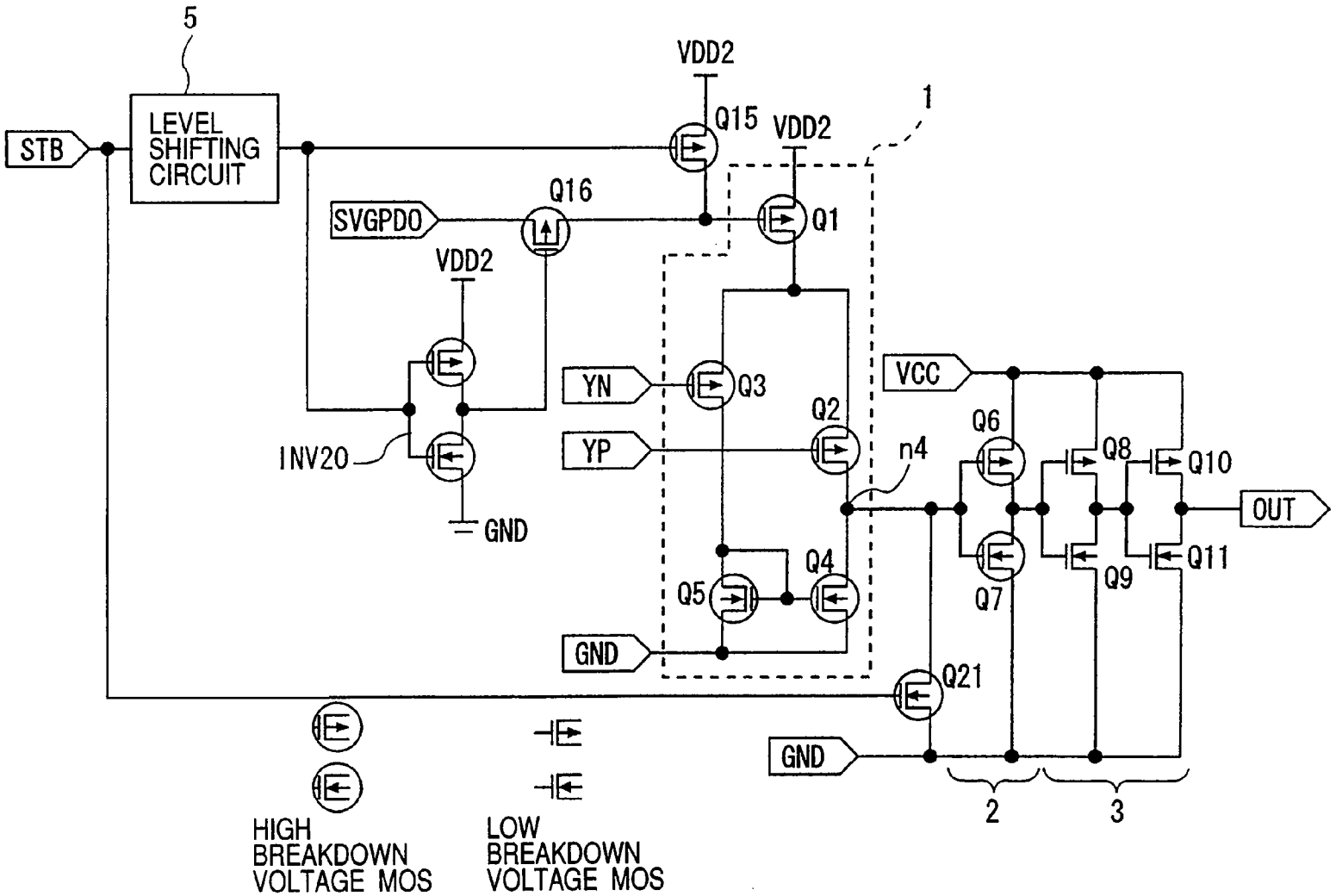
FIG. 16 is a circuit diagram showing a small amplitude differential signal interface of a third embodiment to which a standby function is added.

FIG. 16 shows an example of the small amplification differential signal interface of the second embodiment to which the standby function is added.

In the small amplitude differential signal interface, as a main point different from the small amplitude differential signal interface 101 of FIG. 1, a bias voltage applied to the gate terminal of the MOSFET Q1 for constant current can be changed between a current control voltage SVGPD0 for supplying a constant operation current and the second power supply voltage VDD2. It accompanies a switch MOSFET Q21 for forcedly holding the potential of an output node n4 of the differential amplification stage 1 to the low level when the differential amplification stage 1 is made inactive is provided.

The configuration for switching the bias voltage of the MOSFET Q1 for constant current includes: a level shifting circuit 5 for converting a standby signal STB for logic for driving the high breakdown voltage MOSFET to a high voltage; a P-channel type switch MOSFET Q15 of high breakdown voltage for connecting/disconnecting the power supply voltage VDD2 and the gate terminal of the MOSFET Q1 for constant current; a P-channel type switch MOSFET Q16 of high breakdown voltage for connecting/disconnecting the current control voltage SVGPD0 and the gate terminal of the MOSFET Q1 for constant current, and an inverter INV20 for inverting a signal. In the case where the difference between the power supply voltages VCC and VDD2 is not so much, the level shifting circuit 5 may not be provided.

With the above configuration, when the standby signal STB is at the low level, the switch MOSFET Q16 for connecting the current control voltage SVGPD0 is turned on and the switch MOSFET Q15 for connecting the power supply voltage VDD2 is turned off. The current control voltage SVGPD0 is applied to the gate of the MOSFET Q1 for constant current and the operation current is supplied to the differential amplification stage 1.

Further, the switch MOSFET Q21 connected to the output node n4 is turned off and therefore does not act. Since the switch MOSFET Q21 is of the N channel, a signal input to the gate can turn off the switch MOSFET Q21 without being level-shifted by the level shifting circuit 5.

On the other hand, when the standby signal STB is set to the high level, the switch MOSFET Q15 for connecting the power supply voltage VDD2 is turned on and the switch MOSFET Q16 for connecting the current control voltage SVGPD0 is turned off. Consequently, the power supply voltage VDD2 is applied to the gate of the MOSFET Q2 for constant current, and the operation current of the differential amplification stage 1 is interrupted.

Further, the switch MOSFET Q21 of the node n4 is turned on and the potential of the output node n4 is forcefully decreased to the ground GND. It makes the state of the driving stage 2 and the buffer stage 3 stable and a feed-through current is interrupted.

Although not shown, the standby signal STB is supplied from, for example, a timing control circuit for generating internal timing signals on the basis of a clock signal and a timing pulse input from the outside in the liquid crystal driver having the small amplitude differential signal interface.

Figure 17:
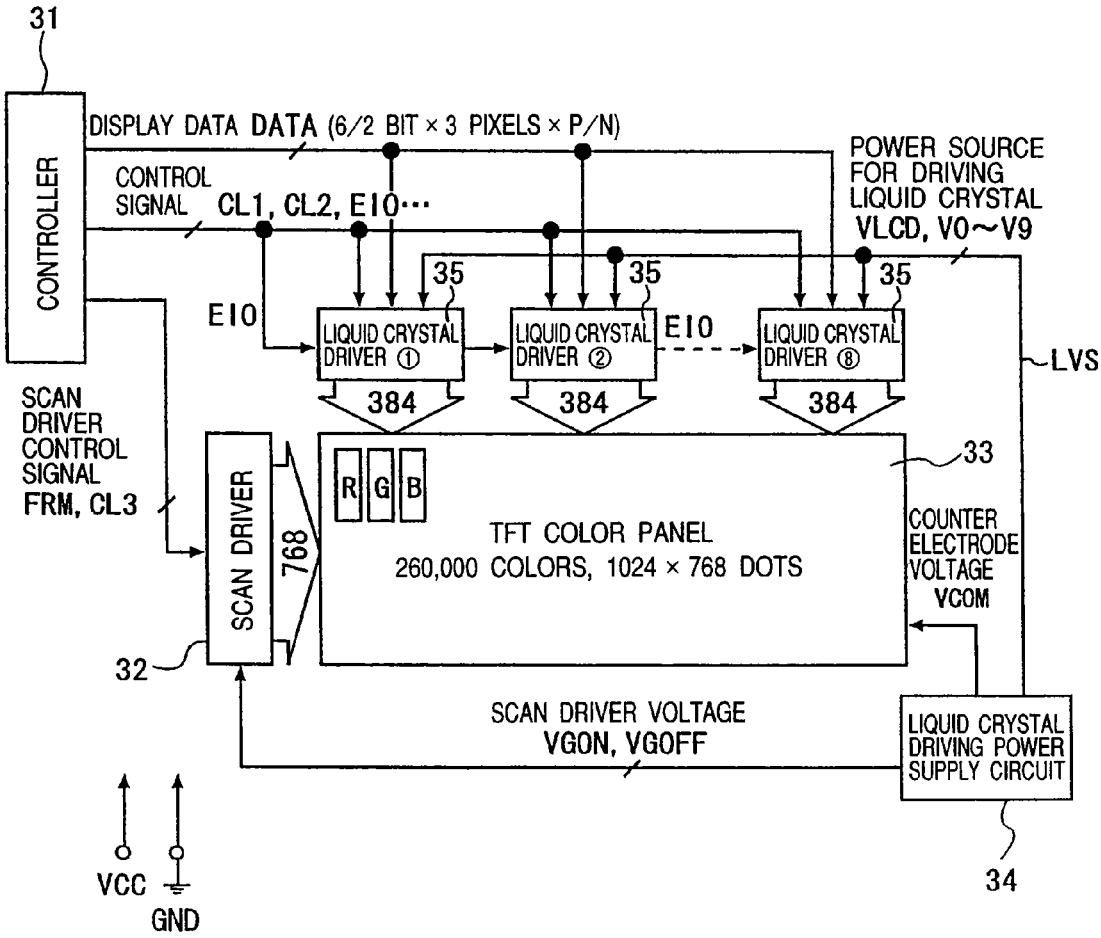
FIG. 17 is a configuration diagram showing an example of a liquid crystal display system constructed by using a liquid crystal driver to which the standby function is added.

FIG. 17 is a configuration diagram showing an example of a liquid crystal display system constructed by using a liquid crystal driver to which the standby function is added. In the following, for easier understanding, the external clock CLK1 input to the data latch circuit 122 in FIG. 2 will be called a horizontal clock CL1 and the external clocks CLP and CLN input to the differential amplifier 12 will be called transfer clocks CL2.

Shown in FIG. 17 are a liquid crystal panel 33 in which a TFT (Thin Film Transistor) array and color filters of three primary colors capable of displaying a color image are disposed on a panel provided with a liquid crystal; a scan driver (gate line driver) 32 for sequentially driving gate lines of the TFT array synchronously with horizontal scan clocks CL3, a liquid crystal driving power supply circuit 34 for generating various power supply voltages necessary to drive a liquid crystal, a liquid crystal driver (source line driver) 35 as the liquid crystal driving device to which the standby function of driving a source line in the TFT array is added, and a controller 31 for supplying display data to the liquid crystal driver 35 and also supplying control signals and operation timings to the liquid crystal driver 35 and the scan driver 32. The liquid crystal display system is provided with terminals and lines for supplying the power supply voltage VCC and the ground potential GND as reference potential to the circuits 31, 32, 34, and 35.

The liquid crystal driving power supply circuit 34 generates a counter electrode voltage VCOM to the liquid crystal panel 33, voltages VGON and VGOFF for driving gate lines of the TFT array to the scan driver 32, and the power supply voltage VLCD for driving liquid crystal and the tone voltages V0 to V9 to the liquid crystal driver 35. A line LVS for supplying voltages VLCD and V0 to V9 output from the power supply circuit 34 is a line for supplying the voltages VLCD and V0 to V9 to the liquid crystal drivers 35 and is also provided for the liquid crystal system of the invention. Therefore, the liquid crystal driver (100, 35) of the invention can be used for the liquid crystal system without changing the line LVS for the liquid crystal system.

In the liquid crystal display system of the embodiment, a plurality of (for example, eight) liquid crystal drivers 35 in accordance with the number of source lines of the liquid crystal panel 33 are disposed. Each of the plurality of liquid crystal drivers 35 drives corresponding 384 (128 pixels×three primary colors) source lines and, on the other hand, the gate lines are sequentially driven by the scan driver 32, thereby displaying an image on the whole area of the liquid crystal panel 33. The liquid crystal system can be constructed by the liquid crystal drivers 100 of the first embodiment in place of the liquid crystal drivers 35 in FIG. 17.

Figure 18:
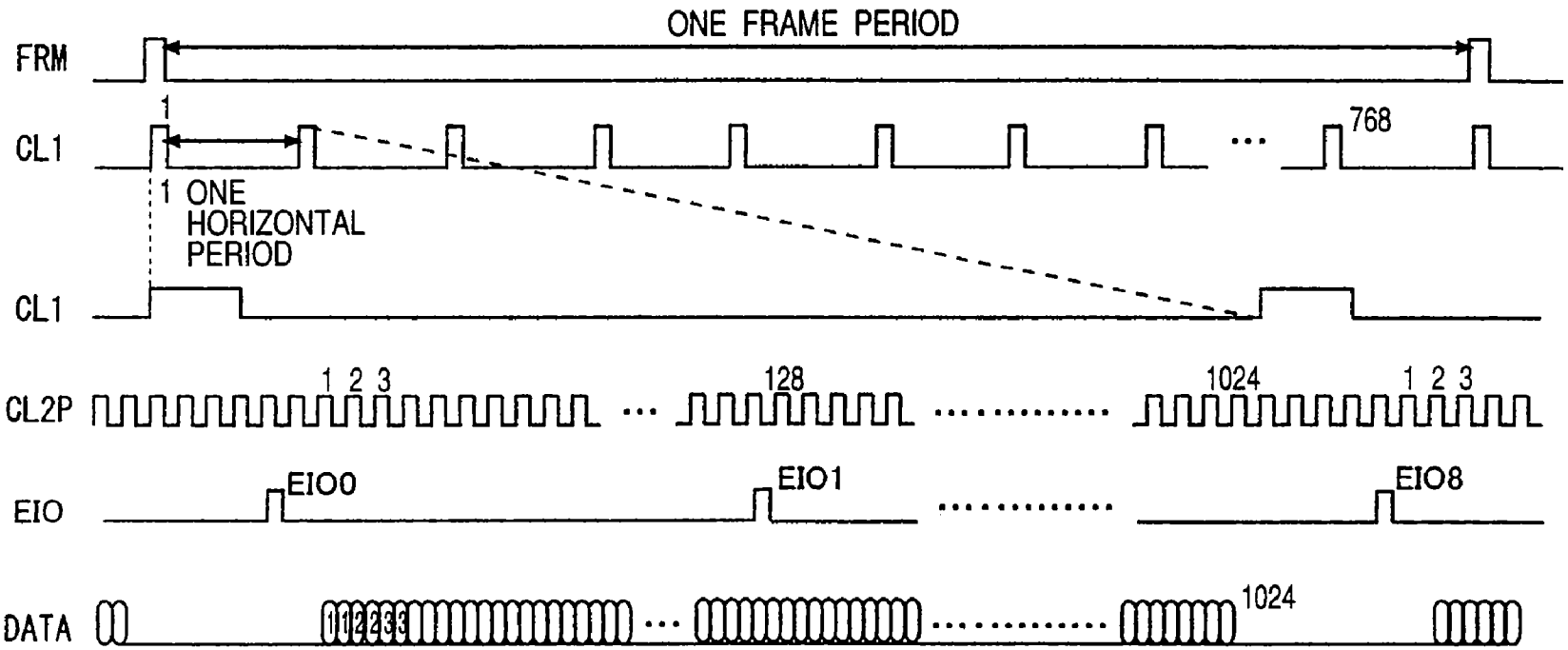
FIG. 18 is a timing chart for explaining the operation of the liquid crystal display system of FIG. 17.

FIG. 18 is a timing chart for explaining the operation of the liquid crystal display system. In the diagram, the scale of the time base for upper two stages and that for lower three stages are different from each other. FRM denotes a frame signal indicative of a frame period.

In the liquid crystal display system of FIG. 17, in addition to display data DATA, the horizontal clock CL1 indicative of one horizontal period, the transfer clock CL2 forgiving transfer timings of the display data DATA, and the like are output from the controller 31 to each of the liquid crystal drivers 35, . . . . The display data DATA is continuously transferred in one horizontal period in a transfer unit of data of three primary colors×1 line (1024 pixels). As the display data DATA and the transfer clock CL2, differential signals are used.

Each of the plurality of liquid crystal drivers 35 receives the display data DATA of three primary colors×128 pixels to be carried by each driver out of the display data DATA of one line continuously transferred. To each of the liquid crystal drivers 35, to input only the display data DATA of the amount for one driver, enable signals EIO for notifying of an input timing of the display data DATA are input at different timings.

First, the enable signal EIO is output from the controller 31 to the first liquid crystal driver 35. Based on the enable signal EIO, the first liquid crystal driver 35 starts receiving display data. After that, transfer continues and, just before completion of data input of the amount to the first liquid crystal driver 35, the enable signal EIO is transferred from the liquid crystal driver 35 to the second liquid crystal driver 35. The second liquid crystal driver 35 starts receiving display data on the basis of the enable signal EIO and, just before completion of reception of data of the amount, transfers the enable signal EIO to the next liquid crystal driver 35. Such a process is executed from the first liquid crystal driver 35 to the final liquid crystal drier 35, thereby inputting the amount obtained by dividing all of display data of one line into each of the plurality of liquid crystal drivers 35.

In FIG. 18, the enable signals EIO output from the controller 31 and the liquid crystal drivers 35, . . . are indicated in a line. EIO0 denotes the enable signal output from the first liquid crystal drier 35 and EIO8 indicates the enable signal EIO output from the final liquid crystal drier 35. The enable signal EIO8 generated by the last liquid crystal drier 35 is not output.

The timing of transferring the enable signal EIO from a liquid crystal drier 35 to the next liquid crystal driver 35 is obtained by, for example, counting the transfer clock CL2 after the enable signal EIO is input in the timing control circuit provided in each of the liquid crystal drivers 35.

As shown in FIGS. 17 and 18, the display data DATA is transferred to the liquid crystal driver 35 at timings of both the rising and falling edges of a clock signal CL2P. The transfer rate is 18 bits in which tone data of 6 bits per pixel are included per clock and is nine bits which is the half of 18 bits per one edge of a clock.

The display data DATA of three primary colors×1 line is transferred in one horizontal period. Until transfer of the next line, there is a blank period in which no display data is transferred. Each liquid crystal driver 35 receives only the display data DATA of the assigned amount during transfer of the display data DATA of one line and does not perform the inputting process during transfer of the other data.

In the liquid crystal driver 35 of the embodiment, therefore, in a period in which the display data DATA is not received, a process of setting the small amplitude differential signal interface 101 to the standby mode and reducing power consumption is performed.

Figure 19:
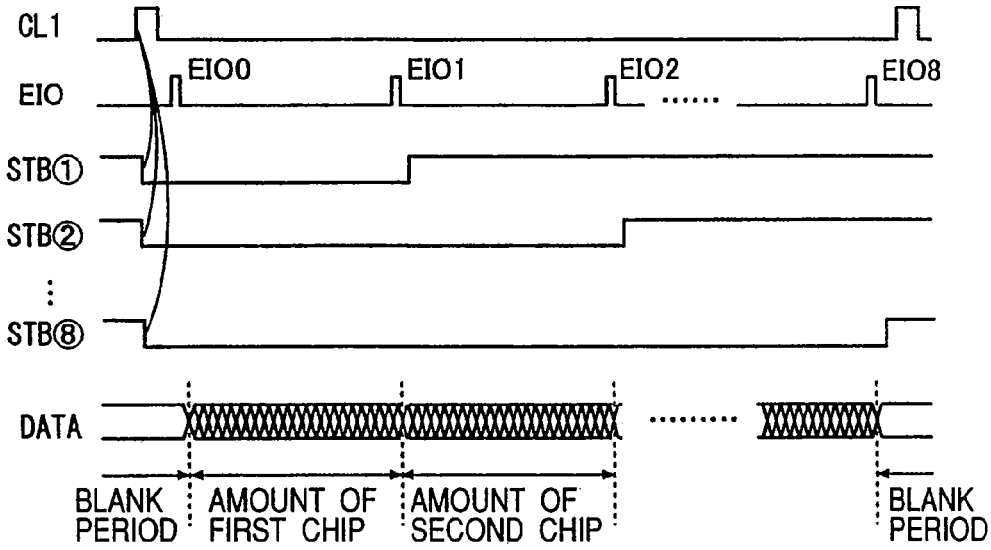
FIG. 19 is a timing chart showing an example of operation timings of a standby process executed by each of liquid crystal drivers.

FIG. 19 shows an example of a timing chart of operation timings of a standby process performed in each liquid crystal driver.

The standby process is executed by using signals necessary for a display control of the liquid crystal display system by a timing control circuit provided in the liquid crystal driver 35.

FIG. 19 shows an example of using the horizontal clock CL1 as a signal for resetting from the standby mode. Specifically, the horizontal clock CL1 from the controller 31 is input from the timing control circuit of each of the liquid crystal drivers 35 and, when the rising edge is detected, the standby signal STB output from the timing control circuit is set to the low level, thereby canceling the standby mode.

On the other hand, the standby mode is started when the timing control circuit of each liquid crystal driver 35 detects completion of input of the display data DATA of the allocated amount. The timing control circuit in each of the liquid crystal drivers 35 starts receiving the display data DATA on the basis of the enable signal EIO input after the horizontal clock CL1 and allows the display data DATA to be received while counting the transfer clock CL2 by a counter. The timing at which the last data of the display data DATA of the allocated amount (3 primary colors×128 pixels) is latched by the data latch circuit 122 or a latch circuit such as the data register 104 via the small amplitude differential signal interface 101 is detected on the basis of a count value of the counter. On the basis of the detection, the standby signal STB output to the small amplitude differential signal interface 101 is set to the high level to move to the standby mode.

Figure 20:
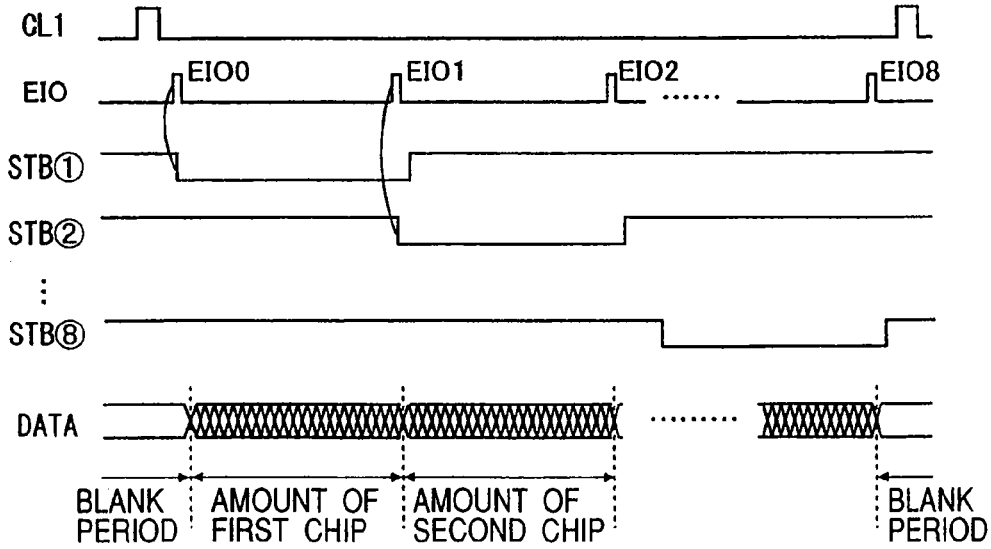
FIG. 20 is a timing chart showing another example of operation timings of a standby process executed by each of liquid crystal drivers.

FIG. 20 shows an other example of the operation timing of the standby process.

In the example, as a signal for resetting the small amplitude differential signal interface 101 from the standby mode, the enable signal EIO is used. Specifically, the standby signal STB supplied to the small amplitude differential signal interface 101 when the rising edge of the enable signal EIO is detected is set to the low level by the timing control circuit provided in each of the liquid crystal drivers 35, thereby canceling the standby mode. The standby mode is started in a manner similar to FIG. 19.

As described above, in the liquid crystal drivers 35 and the liquid crystal display system of the second embodiment, the operation current of the differential amplification stage 1 of the small amplitude differential signal interface 101 is interrupted in the period in which the display data DATA is not transferred in each liquid crystal driver. Consequently, even when the power supply voltage (VDD2) of the differential amplification stage 1 is set to be higher than the power supply voltage (VCC), power consumption can be further reduced.

With respect to the examples of FIGS. 19 and 20, the standby mode can be more efficiently started in the example of FIG. 20 as compared with case of FIG. 19, so that the power consumption can be accordingly reduced more. However, when the period from input of the enable signal EIO to start of receiving the display data DATA is short, there is a fear that the standby mode of the small amplitude differential signal interface 101 cannot be canceled in time. In such a case, it is preferable to use the example of FIG. 19.

Third Embodiment

Figure 21:
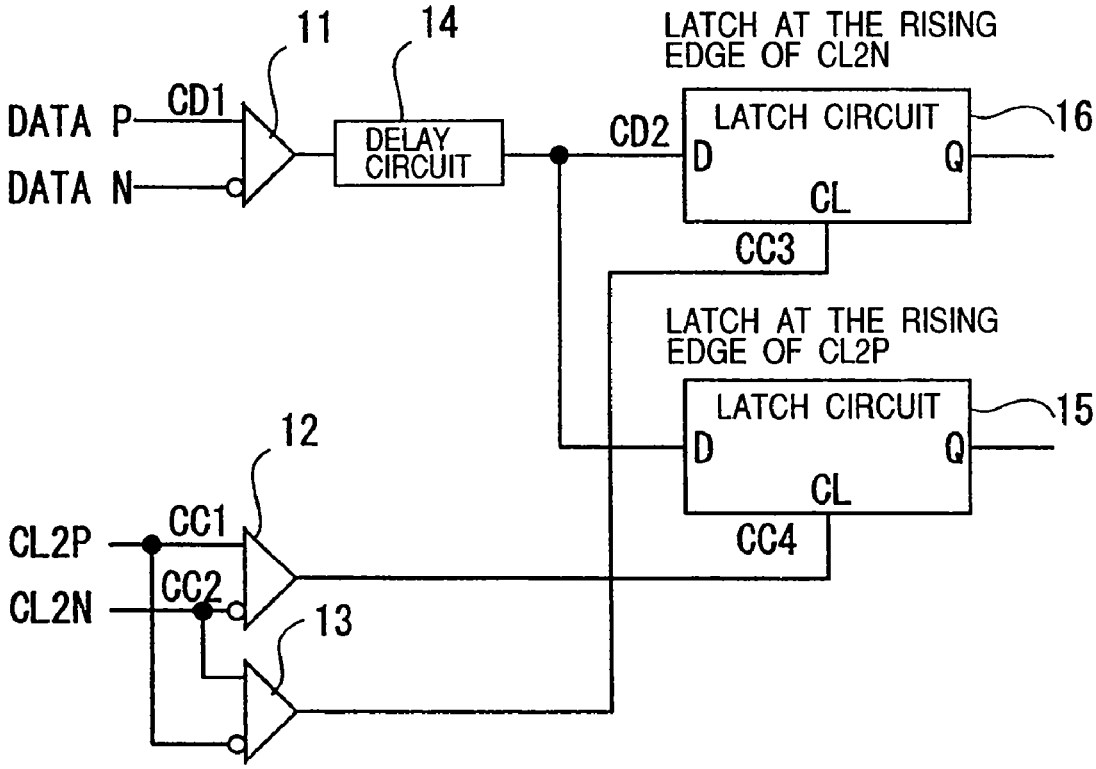
FIG. 21 is a circuit diagram showing an input unit of display data and a transfer clock in the liquid crystal driver of the embodiment.

FIG. 21 is a circuit diagram showing an input section of display data and transfer clocks in a liquid crystal driver of a third embodiment.

In the third embodiment, in the liquid crystal driver shown in the first and second embodiments, an input circuit of the transfer clock CL2 for giving the transfer timing of the display data DATA is improved.

In the case of receiving differential transfer clocks CL2 (the positive phase side of the clock is indicated as CL2P and the negative phase side of the clock is indicated as CL2N) by a differential amplifier, it is difficult to set the rising time and the falling time of the transfer clock CL2 passing through the differential amplification stage to the same due to characteristics of the differential amplifier. A deviation occurs between the rising time and the falling time according to the conditions such as the center voltage of the differential signals, power supply voltage, and temperature. Therefore, in the transfer clock CL2 passing through the differential amplifier, delay time of a rising signal (hereinbelow, called rise delay) and delay time of the falling signal (hereinbelow called fall delay) are different from each other.

Consequently, in the case of inputting the transfer clock CL2 to one differential amplifier and receiving the differential display data DATA twice per clock by using both edges of an input clock (the positive phase side is indicated as DATAP and the negative phase side is indicated as DATAN), for example, when the center voltages of the transfer clocks CL2P and CL2N input from the outside are largely deviated from each other, a clock skew of the transfer clock CL2 becomes large and there is the possibility such that the display data DATA cannot be received correctly. To avoid such problems, in the case of the configuration, only the conditions of the signal waveforms of the transfer clock CL2 and the display data DATA input from the outside have to be strictly specified.

As shown in FIG. 21, the liquid crystal driver of the third embodiment has, therefore, two differential amplifiers 12 and 13 to which the transfer clock CL2 is input, and the display data DATA is latched by latch circuits 15 and 16 synchronously with clock signals CC3 and CC4 of two systems input via the differential amplifiers 12 and 13.

The display data DATA is input via a differential amplifier 11 of the small amplitude differential signal interface 101 and a delay circuit 14 for timing adjustment. The latch circuits 15 and 16 construct the data register 104 (FIG. 2) provided at the post stage of the small amplitude differential signal interface 101.

The differential amplifier 12 as one of the two differential amplifiers 12 and 13 is connected so that the transfer clock CL2P of the positive phase is input to a positive phase input terminal and the transfer clock CL2N of the negative phase is input to a negative phase input terminal. The other differential amplifier 13 is connected so that the transfer clock CL2N of the negative phase is input to a positive phase input terminal and the transfer clock CL2P of the positive phase is input to the negative phase input terminal.

The latch circuit 15 latches the display data DATA at the rising edge of the clock signal CC4 from the differential amplifier 12 and the other latch circuit 16 latches the display data DATA at the rising edge of the clock signal CC3 from the differential amplifier 13.

Figure 22:
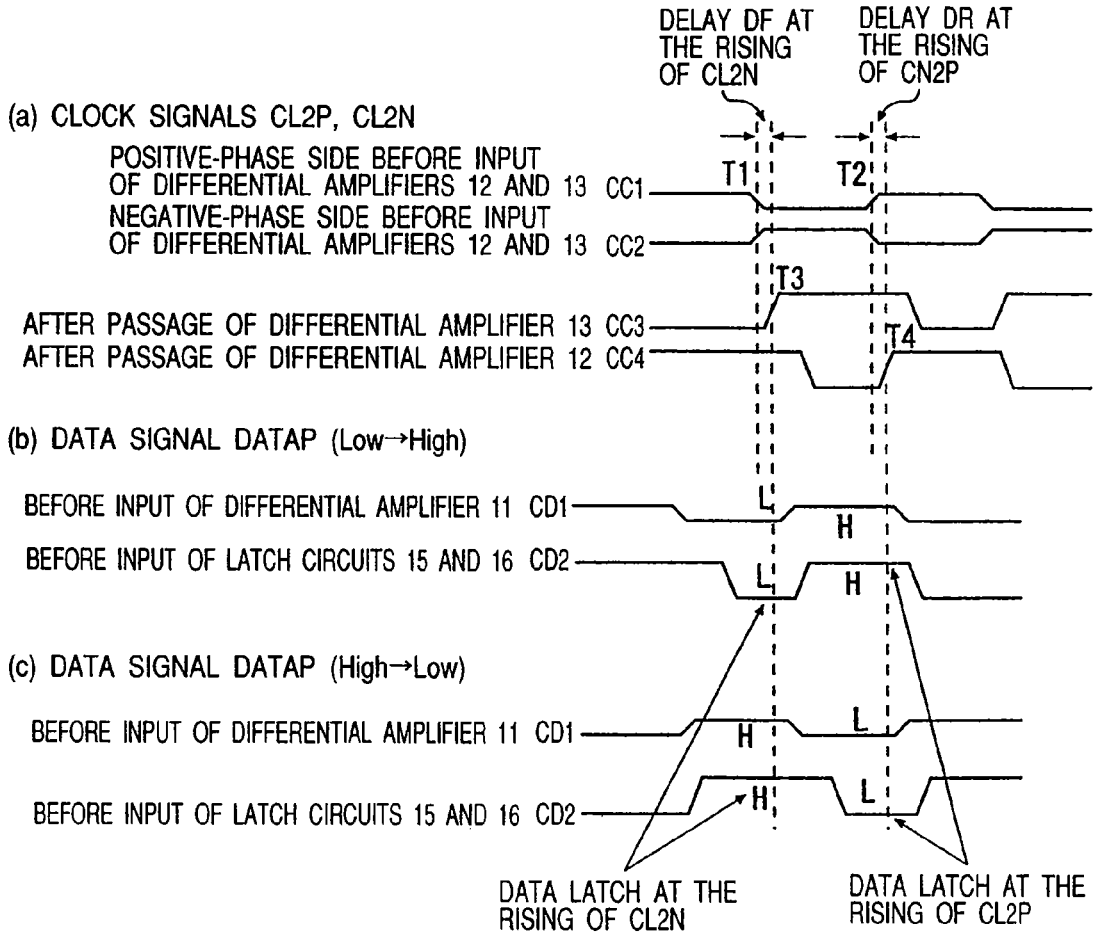
FIG. 22 is a waveform chart showing the relation between the display data and the transfer clock in the circuit of FIG. 21.

FIG. 22 is a waveform chart showing a delay amount of display data and a delay amount of the transfer clock in the circuit of FIG. 21.

With the configuration, as shown in (a) in FIG. 22, a deviation occurs between a rise delay and a fall delay in the differential amplifiers 12 and 13. However, the positive phase input terminal and the negative phase input terminal of the differential amplifier 12 and those of the differential amplifier 13 are connected in an opposite manner. Consequently, the rising timing T3 of the signal CC3 passed through the differential amplifier 13 becomes a timing obtained by adding a rise delay DF to the falling timing T1 of the transfer clock CL2P (=signal CC1), and the rising timing T4 of the signal CC4 passed through the differential amplifier 14 becomes a timing obtained by adding a rise delay DR of the differential amplifier 13 to the rising timing T2.

Therefore, according to the method of inputting the transfer clock CL2 of the third embodiment, the interval between the rising edge of the signal CC4 as the latch timing of the latch circuit 15 and the rising edge of the signal CC3 as the latch timing of the latch circuit 16 becomes uniform. Accordingly, a latch error of the display data DATA does not easily occur. Consequently, the conditions of the center voltages of the differential transfer clocks CL2 and the differential display data DATA can be eased and, further, the display data DATA can be transferred at higher speed.

Although the invention achieved by the inventors herein has been described concretely on the basis of the embodiments, obviously, the invention is not limited to the foregoing first to third embodiments but can be variously changed without departing from the gist.

For example, the horizontal clock CL1 and the enable signal EIO are used to cancel the standby mode in the third embodiment, in the case where a signal indicative of start of continuous transfer of display data is used in the system, the standby mode can be canceled by using such a signal. In the case where a signal indicative of end of continuous transfer of display data is used in the system, the standby mode may be started by using such a signal. A standby signal itself is input from the outside of the chip and may be supplied to each of liquid crystal drivers by a controller or the like which performs a timing control of each block.

Although the configuration of switching the bias voltage of the MOSFET Q1 for current has been described in the third embodiment as the configuration of interrupting the operation current of the differential amplification stage of the small amplitude differential signal interface 101 in the standby mode, there are other various methods such as a configuration of interrupting supply of the power supply voltage VDD2.

Although the second embodiment has been described so as to set the standby mode every horizontal period, in the case where there is a horizontal period in which display data is not transferred in the beginning or end of a frame period, all of the horizontal periods may be set to the standby mode. Also in the case where the standby mode is set only in the beginning or end of a frame period and the standby mode is canceled in a horizontal period in which display data is transferred, power consumption can be reduced as compared with the conventional technique.

In the input circuit of the transfer clock CL2 of the third embodiment, the two differential amplifiers for receiving the transfer clock CL2 do not have to have the same circuit configuration. If the rise delay or fall delay in the two differential amplifiers becomes the same, the circuit configuration is arbitrary.

In the first embodiment, to stably receive the differential display data DATA, the operation voltage of the differential amplification stage 1 is set to be larger than the operation voltage VCC of the driving stage 2 and the buffer stage 3 in the post stage in the small amplitude differential signal interface 101. Alternately, in place of increasing the operation voltage, the small amplitude differential signal interface 101 may be constructed by using a MOSFET of a low threshold voltage as an element of the differential amplification stage 1 and using a MOSFET of a high threshold voltage as an element of the driving stage 2 and the buffer stage 3 in the post stage. By an action similar to the case of switching the operation voltage, the display data DATA can be stably latched.

Effects obtained by representative inventions out of the inventions disclosed in the specification will be briefly described as follows.

The invention produces an effect such that, in a differential circuit such as the small amplitude differential signal interface, the fluctuation permissible width of the center voltage of the input differential signals can be made wide and power consumption can be reduced.

The invention also provides an effect such that, in a semiconductor integrated circuit having the small amplitude differential signal interface, the wide fluctuation permissible width of the input differential signal and the low power supply voltage for logic are achieved, thereby realizing reduction in power consumption.

Since the operation current passed to the differential amplification stage of the small amplitude differential signal interface is interrupted in a blank period in which no display data is transferred by the standby function, power consumption of the liquid crystal driving circuit and power consumption of the liquid crystal system can be further reduced.

By employing the function of automatically canceling the standby function on the basis of the horizontal clock and the enable signal notifying of continuous transfer of display data and the function of automatically starting the standby function by detecting the end of a series of display data continuously transferred, effects such that a new external signal does not have to be provided for the standby function and the conventional system can be applied as it is are produced.

In an input interface for inputting data twice per clock by using both edges of differential clock signals, clock signals are input by two differential amplifiers in which the input terminals of the positive phase and those of the negative phase are connected so as to be opposite to each other and data is latched by using the clock signals, thereby enabling data to be stably latched while reducing a clock skew. Moreover, the conditions of waveforms of the differential clock signals and data signals are eased and data transfer of higher speed can be performed.

INDUSTRIAL APPLICABILITY

Although the invention achieved by the inventors herein has been described mainly by the liquid crystal driver in the field of utilization as the background, the invention is not limited to the liquid crystal driver. The invention can be widely used for a semiconductor integrated circuit such as a 1-chip microcomputer or a DSP (Digital Signal Processor) having a small amplitude differential signal interface and receiving supply of two power supply voltages which is a voltage for internal logic circuits and a voltage for the interface.

The invention claimed is:

1. A liquid crystal drive device, comprising:

a differential type input circuit including a differential amplification stage for receiving a differential signal and an output stage for generating an output signal on the basis of an output of the differential amplification stage, receives display data via the input circuit and outputs a signal for driving a liquid crystal on the basis of the display data;

two clock input circuits for receiving differential external clocks; and a first latch for latching one of said two input signals serially input per external clock and a second latch for latching the other signal, wherein a positive-phase signal of an external clock is input to a positive-phase input terminal and a negative-phase signal is input to a negative-phase input terminal in one of the clock input circuits, wherein a negative-phase signal of an external clock is input to a positive-phase input terminal and a positive-phase signal is input to a negative-phase input terminal in the other clock input circuit, wherein two input signals are serially input per external clock to said input circuit, wherein timings of receiving the two input signals are given on the basis of two clock signals input via said two clock input circuits, respectively, wherein latch timings of the first and second latches are provided on the basis of two clock signals input via said two clock input circuits, and wherein said differential amplification stage has standby means for interrupting an operation current flowing in the differential amplification stage.

2. The liquid crystal drive device according to claim 1, wherein a liquid crystal driving voltage larger than an operation voltage supplied as an operation voltage to said output stage is supplied to said differential amplification stage.

3. The liquid crystal drive device according to claim 2, wherein the liquid crystal driving voltage to be supplied to said differential amplification stage is a tone voltage which is input from the outside in order to generate a tone drive voltage for tone-driving a liquid crystal panel.

4. The liquid crystal drive device according to claim 1, wherein said differential amplification stage has two differential input MOS transistors having a common source and gates receiving a pair of differential signals, and a MOS transistor for current having a drain to which the common source of the two differential input MOS transistors is connected and having a source to which an operation voltage is supplied, and wherein said standby means is means for switching a bias voltage applied to the gate of said MOS transistor for current.

5. The liquid crystal drive device according to claim 1, further comprising control means for canceling interruption of an operation current by said standby means on the basis of an external signal indicative of a timing at which a plurality of pieces of display data are continuously transferred and starting interruption of the operation current by said standby means on the basis of detection of completion of input of the display data continuously transferred.

6. The liquid crystal drive device according to claim 1, wherein said timing is provided by either a rising edge or a falling edge of each of two clock signals input via said two clock input circuits.

* * * * *